US009606462B2

(12) United States Patent
Nomura et al.

(10) Patent No.: US 9,606,462 B2
(45) Date of Patent: Mar. 28, 2017

(54) TONER AND METHOD FOR MANUFACTURING TONER

(71) Applicant: CANON KABUSHIKI KAISHA, Tokyo (JP)

(72) Inventors: Shotaro Nomura, Suntou-gun (JP); Koji Nishikawa, Susono (JP); Kosuke Fukudome, Tokyo (JP); Daisuke Yoshiba, Suntou-gun (JP); Shohei Tsuda, Suntou-gun (JP); Hiroki Akiyama, Toride (JP); Katsuhisa Yamazaki, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/814,873

(22) Filed: Jul. 31, 2015

(65) Prior Publication Data

US 2016/0041481 A1 Feb. 11, 2016

(30) Foreign Application Priority Data

Aug. 7, 2014 (JP) ..... 2014-161479

(51) Int. Cl.
*G03G 9/08* (2006.01)
*G03G 9/097* (2006.01)

(52) U.S. Cl.
CPC ..... *G03G 9/0825* (2013.01); *G03G 9/0808* (2013.01); *G03G 9/0827* (2013.01);
(Continued)

(58) Field of Classification Search
CPC .. G03G 9/0825; G03G 9/0827; G03G 9/0808; G03G 9/09708; G03G 9/09716; G03G 9/09733
(Continued)

(56) References Cited

U.S. PATENT DOCUMENTS 9,201,323 B2 * 12/2015 Nishikawa ..... G03G 9/09708
2014/0295341 A1 10/2014 Fomitchev et al.
(Continued)

FOREIGN PATENT DOCUMENTS

JP 2000-292972 A 10/2000
JP 2005-202131 A 7/2005
(Continued)

OTHER PUBLICATIONS

U.S. Appl. No. 14/812,793, filed Jul. 29, 2015. Inventors: Shohei Tsuda, et al.
(Continued)

*Primary Examiner* — Mark A Chapman
(74) *Attorney, Agent, or Firm* — Fitzpatrick, Cella, Harper & Scinto

(57) ABSTRACT

To provide a toner from which an image having a stable image density can be obtained with reduced occurrence of pollution of members, even when a toner container is filled with a larger amount of toner than a conventional amount for long-term use. A toner including a toner particle and an external additive containing an organic-inorganic composite fine particle and an inorganic fine particle A; wherein the organic-inorganic composite fine particle includes a resin particle and an inorganic fine particle B, the resin particle has a surface with a convex derived from the inorganic fine particle B; has a specific number average particle diameter (D1) and a specific shape factor SF-2; and has a specific fixed state to the toner particle; the organic-inorganic composite fine particle has a specific unit diffusion index on the toner particle surface; the inorganic fine particle A has a specific BET specific surface area.

6 Claims, 9 Drawing Sheets

(52) U.S. Cl.
CPC ..... *G03G 9/09708* (2013.01); *G03G 9/09716* (2013.01); *G03G 9/09733* (2013.01)

(58) Field of Classification Search
USPC ..... 430/108.6
See application file for complete search history.

(56) References Cited

U.S. PATENT DOCUMENTS

| | | | |
|---|---|---|---|
| 2015/0037719 | A1 | 2/2015 | Naka et al. |
| 2015/0037723 | A1 | 2/2015 | Nishikawa et al. |
| 2015/0125790 | A1 | 5/2015 | Hotta et al. |

FOREIGN PATENT DOCUMENTS

| | | | |
|---|---|---|---|
| JP | 2006-106801 | A | 4/2006 |
| JP | 4321272 | B2 | 8/2009 |
| JP | 2013-92748 | A | 5/2013 |
| WO | 2013/063291 | A1 | 5/2013 |

OTHER PUBLICATIONS

U.S. Appl. No. 14/817,201, filed Aug. 3, 2015. Inventors: Kazuo Terauchi, et al.

* cited by examiner r<0.8L r≥0.8L

TONER AND METHOD FOR MANUFACTURING TONER

BACKGROUND OF THE INVENTION

Field of the Invention

The present invention relates to a toner for use in electrophotography, electrostatic recording, magnetic recording, etc., and a method for manufacturing a toner.

Description of the Related Art

Due to the cost consciousness and the environmental consciousness which have recently been enhanced, an electrophotographic apparatus such as a copier and a printer is required to be used for a longer period than before. An example of the method for enabling use for a longer period includes filling a toner container with a larger amount of toner, which enhances the convenience for users, giving cost advantages to users through saving resources.

In order to increase the filling amount of toner, however, there exist many problems to be technically solved.

The toner in the container is continuously subjected to agitation for supply of the toner to a developing apparatus. Consequently the toner is subjected to a physical load for a long period. With an increased total amount of toner, an agitation/circulation mechanism in the toner container is required to be upsized and reinforced than before. In this respect also, the physical load applied to the toner increases.

The fluidity of toner is imparted by adding an external additive. In the case of toner subjected to a physical load, however, the external additive is embedded in the toner particle surface, causing a problem that the fluidity of toner decreases. In the case of using an external additive having a small particle diameter, in particular, the fluidity markedly decreases.

Accordingly, many trials have been performed to improve the durability to the physical load applied to toner by using an external additive of an inorganic particle or an organic-inorganic composite fine particle having a large particle diameter, which is more hardly embedded, as described in Japanese Patent Application Laid-Open No. 2000-292972, Japanese Patent Application Laid-Open No. 2005-202131 and Japanese Patent Application Laid-Open No. 2013-92748. The external additives with a large particle diameter, however, has weak physical/electrostatic adhesion to the toner surface due to the size, so as to be easily liberated, causing pollution of various members in an electrophotographic process, which is a problem.

Accordingly, an external additive for use having a large particle diameter is required to have stronger adhesion to the toner surface in comparison with conditions for a conventional external additive having a small particle diameter, so that the conditions for external addition have been widely investigated. In order to achieve stronger adhesion to the toner surface, extension of treatment time has been also investigated (Japanese Patent Application Laid-Open No. 2006-106801). In this case, however, the external additive having a large particle diameter is swept into recesses in the toner particle surface, so that sufficient covering effect of the external additive cannot be obtained.

SUMMARY OF THE INVENTION

The present invention is directed to providing a toner capable of solving the problem.

More specifically, the present invention is directed to providing a toner from which an image having a stable image density can be obtained with reduced occurrence of pollution of members, even when a toner container is filled with a large amount of toner for use for a long period.

Further, the present invention is directed to providing a method for manufacturing the toner.

According to one aspect of the present invention, there is provided a toner including a toner particle containing a binder resin, a colorant and a releasing agent, and an external additive containing an organic-inorganic composite fine particle and an inorganic fine particle A; in which the organic-inorganic composite fine particle: (1) includes a resin particle and an inorganic fine particle B which is embedded in the resin particle, and has a surface with a convex portion derived from the inorganic fine particle B; (2) has a number average particle diameter (D1) of 50 nm or more and 500 nm or less; (3) has a shape factor SF-2 of 103 or more and 120 or less as measured at a magnification of 200000; and (4) has a proportion Y (parts by mass) of a particle firmly fixed to the toner particle of 0.45 parts by mass or more and 3.00 parts by mass or less with respect to 100 parts by mass of the toner particle; when a content proportion of the organic-inorganic composite fine particle is X parts by mass with respect to 100 parts by mass of the toner particle, the X and the Y satisfy the following expression:

$$X-Y\leq 0.30;$$

the organic-inorganic composite fine particle has a unit diffusion index of 0.75 or more on the toner particle surface calculated from the following formula:

Unit diffusion index=(organic-inorganic composite fine particle coverage ratio on toner particle surface obtained from measurement)/(organic-inorganic composite fine particle coverage ratio on toner particle surface for ideal diffusion of organic-inorganic composite fine particle);

the inorganic fine particle A has a BET specific surface area of 50 $m^2/g$ or more and 400 $m^2/g$ or less.

According to another aspect of the present invention, there is provided a method for manufacturing the toner described above including: (A) a first mixing step of mixing the toner particle and the organic-inorganic composite fine particle using a treating apparatus having a rotator in a treatment chamber so as to produce a mixture; and (B) a second mixing step of mixing the mixture and the inorganic fine particle A using a treating apparatus having a rotator in a treatment chamber so as to produce a toner.

According to the present invention, a toner from which an image having a stable image density can be obtained with reduced occurrence of pollution of members can be provided, even when a toner container is filled with a large amount of toner for use for a long period.

Further features of the present invention will become apparent from the following description of exemplary embodiments with reference to the attached drawings.

DESCRIPTION OF THE EMBODIMENTS

Figure 1A:
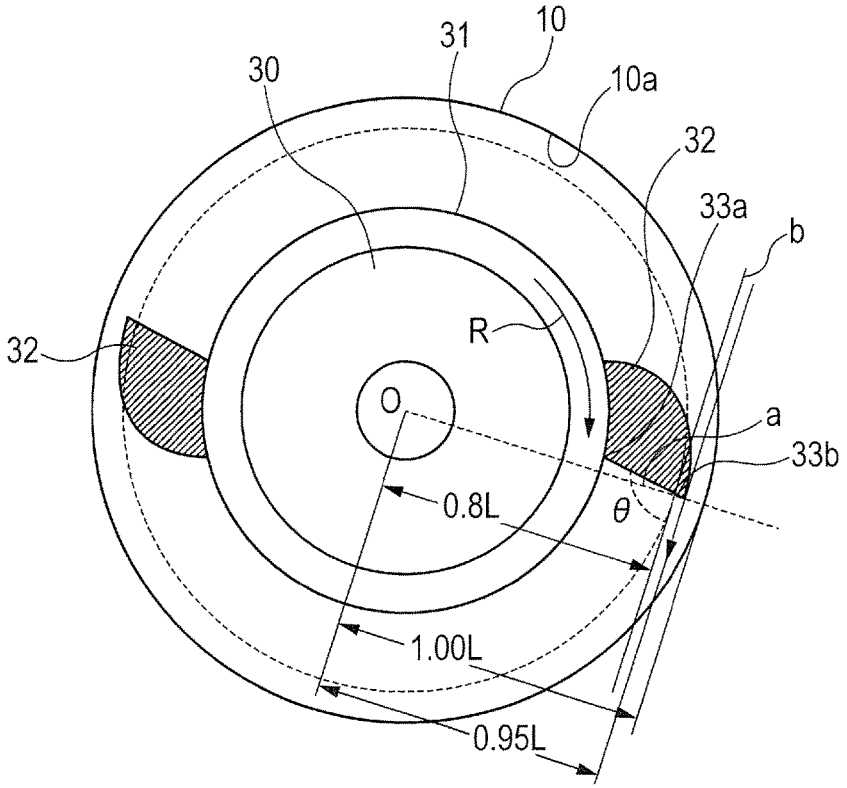
FIG. 1A is a schematic view (top view) illustrating the structure of the rotator in an embodiment of a toner treating apparatus.

Preferred embodiments of the present invention will now be described in detail in accordance with the accompanying drawings.

With use of a toner container filled with a large amount of conventional toner for use in a longer term, it was difficult to obtain an image having a stable image density with reduced occurrence of pollution of members.

As a result of investigation by the present inventors, it was found that the problem can be solved by using an organic-inorganic composite fine particle having surface roughness as an external additive instead of a conventional inorganic particle having a spherical shape, and controlling the ratio between the particle to which the organic-inorganic composite fine particle is firmly fixed and other particle, and the diffusion state of the external additive on the toner surface being within specified ranges, respectively. The details are described as follows.

When a toner container is filled with a larger amount of toner than a conventional amount for use for a long period, the toner is subjected to more physical loads, so that various problems occur. More specifically, with increased collision frequency of toners due to increase in the number of toner and densification of toner, embedding of an external additive is facilitated. In addition, the external additive is facilitated to move to a recess on the toner surface (so-called "sweeping" phenomenon) even with a weak impact hardly causing embedding, so that the covering effect of the external additive is lost, resulting in lowering of fluidity and electrostatic chargeability.

Furthermore, in parallel with the phenomena, the number of contact with the inside of the container and members such as a developing sleeve increases, so that a liberated external additive is facilitated to adhere to and accumulate on the members.

In contrast, use of an organic-inorganic composite fine particle having a large particle diameter causes difficulty in embedding due to the size, in the first place. In addition, the convex portion is hooked on the toner particle surface, so that the particle hardly moves on the toner surface when a high physical load is applied due to a large amount of filling, achieving a high covering effect even after use for a long period. The present inventors found that having a diffusion index, i.e., organic-inorganic composite fine particle coverage ratio divided by an ideal coverage ratio at the number of parts added, within a specified range in the beginning allows sufficient diffusibility to be retained even after long term use, so that the covering effect can be maintained.

In addition, the convex portion of the organic-inorganic composite fine particle bitten with the toner surface has an anchor effect, so that detachment from the toner surface is prevented, thereby reducing the pollution of members.

On this occasion, it was found to be important that the organic-inorganic composite fine particle is classified into:

(1) a firmly fixed particle having an effect for electrostatically charging the toner and an effect for enhancing the hydrophobicity of the toner; and (2) a loosely adhered particle to the toner particle having an effect for imparting the fluidity of the toner; such that each of the amounts is controlled.

It was also found that external addition of an inorganic fine particle having a small particle diameter in addition to the organic-inorganic composite fine particle assists smooth start in electrostatic charging and fluidity from a halt state, and allows a sufficient image density to be always obtained in long-term intermittent use.

The present invention is more specifically described as follows.

The present inventors found that the organic-inorganic composite fine particle for exerting the effects described above is required to have a structure with a resin particle surface in which an inorganic fine particle B is embedded. In addition, the surface of the organic-inorganic composite fine particle is required to have a convex portion derived from the inorganic fine particle B. As long as the inorganic fine particle B is present on the surface of the organic-inorganic composite fine particle, the presence of the inorganic fine particle inside the resin particle is not particularly required.

As an index for the shape of the organic-inorganic composite fine particle, the shape factor SF-2 measured from an enlarged image of the organic-inorganic composite fine particle with a magnification of 200000 using a scanning electron microscope is required to be 103 or more and 120 or less. The shape factor SF-2 is an index indicating the degree of surface irregularities of a particle. A SF-2 value of 100 indicates a perfect circle, and the degree of surface irregularities increase with the value. With an SF-2 less than 103, the shape is too approximate to a perfect circle, so that the effects of the convex portion for preventing sweeping on the toner particle surface and preventing detachment cannot be sufficiently exerted, which is not preferred.

Further, in order to functioning as an external additive having a large particle diameter, the organic-inorganic composite fine particle is required to have a number average particle diameter of 50 nm or more and 500 nm or less. With a number average particle diameter larger than 500 nm, the toner surface having a size of several μm cannot be sufficiently covered and the adhesion to the toner particle surface is substantially reduced, which is not preferred. With a number average particle diameter smaller than 50 nm, embedding in the toner particle surface occurs, due to insufficient physical load bearing capacity for filling in a large amount, which is not preferred.

Further, a proportion Y (part by mass) of the organic-inorganic composite fine particle firmly fixed to a toner particle is 0.45 parts by mass or more and 3.00 parts by mass or less with respect to 100 parts by mass of toner particle, and when X parts by mass represents the proportion of the organic-inorganic composite fine particle with respect to 100 parts by mass of toner particle, X and Y is required to satisfy the following expression:

$$X-Y\leq 0.30$$

The proportion represented by the "X−Y" represents the proportion of the particle loosely adhered to the toner particle (hereinafter also referred to as weakly adhered particle). With a proportion of the weakly adhered particle more than 0.30 parts by mass, the organic-inorganic composite fine particle adheres to and accumulates on members such as a developing sleeve in long-term use. The adhered or accumulated point functions as a starting point for harmful fusing or occurrence of pollution of members, which is not preferred. With a proportion Y of the firmly fixed particle less than 0.45 parts by mass, the toner particle surface cannot be sufficiently covered, so that the exposed toner particle surface absorbs water, with developability lowering due to insufficient electrostatic chargeability. The fluidity also lowers, so that harmful effects such as fading occur in long term use, which is not preferred. With a proportion Y of firmly fixed particle more than 3.00 parts by mass, the fixation performance of the toner lowers and electrostatic cohesion of the toner occurs due to excessive electrostatic chargeability, resulting in lowering of developability or the like, which is not preferred.

The degree of diffusion of the organic-inorganic composite fine particle is represented by a unit diffusion index. The unit diffusion index is a value of the organic-inorganic composite fine particle coverage ratio on the toner particle surface obtained from observation of the toner divided by the coverage ratio on the toner particle surface for ideal diffusion of an organic-inorganic composite fine particle. In other words, the value is obtained from the following expression:

Unit diffusion index=(Organic-inorganic composite fine particle coverage ratio on toner particle surface obtained from measurement)/(Organic-inorganic composite fine particle coverage ratio on toner particle surface for ideal diffusion of organic-inorganic composite fine particle)

The covering state for ideal diffusion means the state that the toner surface is covered with one layer of the organic-inorganic composite fine particle without overlapping or accumulation at a recess. As the unit diffusion index is closer to 0, a diffusion state is closer to the ideal diffusion state of the organic-inorganic composite fine particle. To the contrary, as the unit diffusion index is closer to 0, the organic-inorganic composite fine particle is more swept to a recess of the toner surface or the like, and is more aggregated. The diffusion index is required to be 0.75 or more. With a diffusion index less than 0.75, even an organic-inorganic composite fine particle is subjected to the progress of sweeping in long-term use, the effect of covering the toner particle surface with an external additive is lost to a degree that affects the performance of the toner, which is not preferred.

The inorganic fine particle A for use in combination with the organic-inorganic composite fine particle is required to have a specific surface area of 50 $m^2/g$ or more and 400 $m^2/g$ or less, measured by nitrogen adsorption BET method. With a specific surface area less than 50 $m^2/g$, the excessively large particle diameter results in insufficient performance for imparting electrostatic chargeability, which is not preferred. With a specific surface area larger than 400 $m^2/g$, the excessively small particle diameter results in easy embedding by physical impact even in a presence of the organic-inorganic composite fine particle, which is not preferred.

As a result of investigation by the present inventors, it was found that the fixing state of the organic-inorganic composite fine particle as described above cannot be achieved by a conventional method for treating toner. In order to achieve the fixing state described above, it is required that the organic-inorganic composite fine particle and the inorganic fine particle A are externally added in two steps, and the treatment surface and the shape of a toner treating apparatus are controlled. The details thereof are described as follows.

In a mixing step, it is required that an organic-inorganic composite fine particle is externally added, and then an inorganic fine particle A is externally added separately. In the case of concurrent external addition of the organic-inorganic composite fine particle and the inorganic fine particle A, with a sufficient strength for firmly fixing the organic-inorganic composite fine particle, the inorganic fine particle A is embedded in the toner surface, so that the function thereof cannot be sufficiently exerted, which is not preferred. Also, in the case of external addition with strength suitable for the inorganic fine particle A, the organic-inorganic composite fine particle cannot be firmly fixed, so that an excessive amount of loosely adhered particle (particle easily detached from the toner particle surface) causes pollution of members, which is not preferred. Yet, when the organic-inorganic composite fine particle is externally added, a small amount of inorganic fine particle A may be concurrently added in order to improve treatability.

The present inventors identifies the problems in the existing method in external addition of the organic-inorganic composite fine particle as follows. In the first place, an existing apparatus for external addition has a low collision rate between objects to be treated (toner particle and external additive) and a treatment surface, so that it is difficult to sufficiently firmly fix the external additive. Accordingly, it is required to take a certain length of time in treatment for the external additive to be firmly fixed. Due to the low frequency of collision itself between the treatment surface and the objects to be treated, however, a long-term treatment is required for sufficiently firm fixing. The long-term treatment causes not only the collision between the treatment surface and the objects to be treated, but also a large number of relatively weak collisions between the objects to be treated. Consequently, due to many impacts applied to the external additive at the toner surface to a degree not causing embedding or firm fixing, sweeping of the external additive is presumed to occur.

In order to achieve the adhering state of the organic-inorganic composite fine particle as described above, the present inventors presumed the necessity for an external addition apparatus which has a higher collision rate between the objects to be treated and the treatment surface and a capability for treatment in a short time with an increased collision frequency. The reason is that firm fixation of the external additive in a short time is presumed to prevent the reduction in diffusibility due to sweeping.

A toner treating apparatus for use in manufacturing the toner of the present invention is more specifically described as follows.

Figure 2:
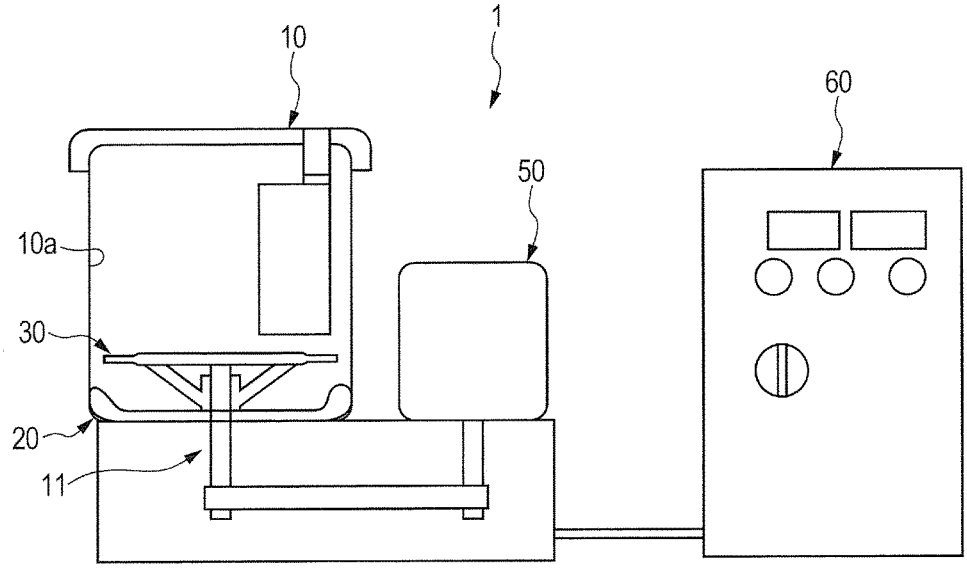
FIG. 2 is a schematic view illustrating the structure of a toner treating apparatus in an embodiment, usable in the present invention.

A schematic view of a toner treating apparatus 1 is illustrated in FIG. 2.

The toner treating apparatus 1 includes a treatment chamber (treatment tank) 10, an agitating blade 20 as a blow-up unit, a rotator 30, a drive motor 50, and a control part 60. The treatment chamber 10 accommodates objects to be treated including a toner particle and an external additive. The agitating blade 20 is rotatably installed at the bottom of the treatment chamber 10 below the rotator 30 in the treatment chamber. The rotator 30 is rotatably installed above the agitating blade 20.

Figure 3:
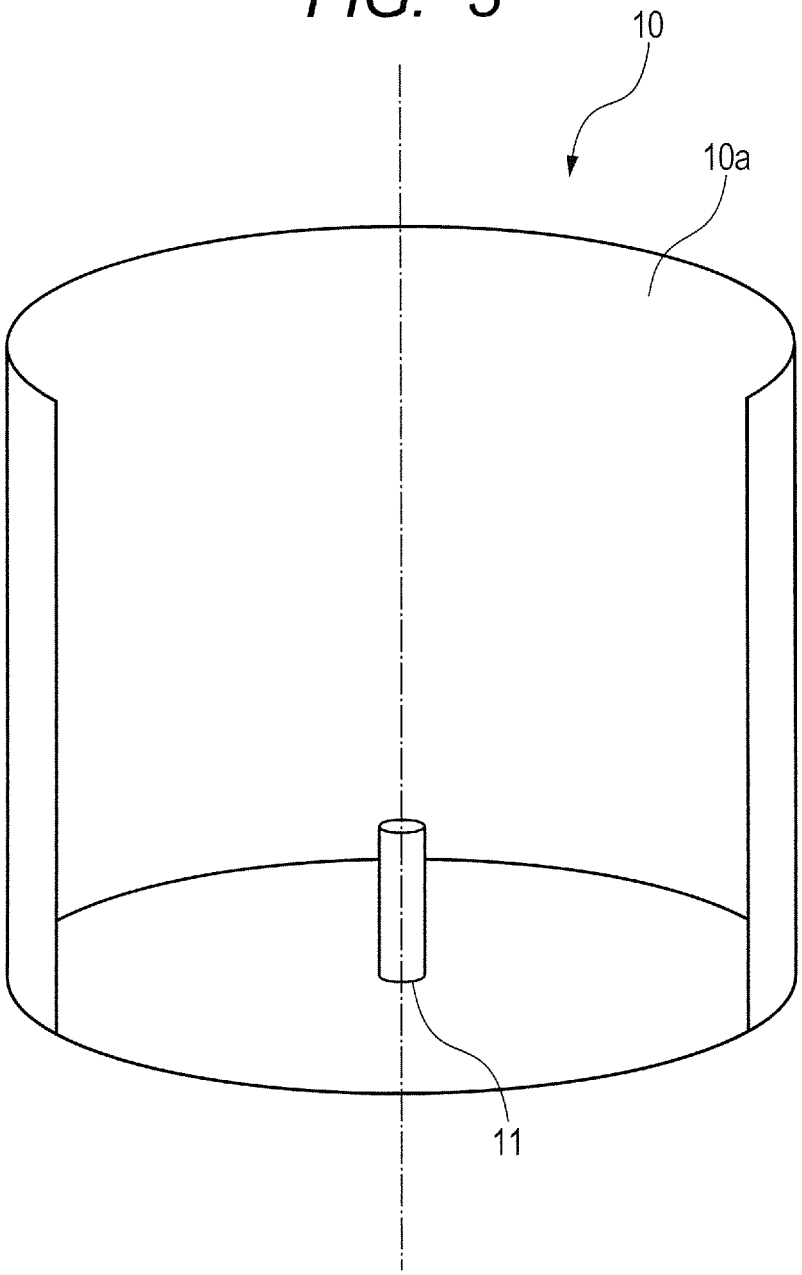
FIG. 3 is a schematic view illustrating the structure of the treatment chamber in an embodiment of a toner treating apparatus.

The schematic view of the treatment chamber 10 is illustrated in FIG. 3. In FIG. 3, for convenience of description, a partial cross-sectional view of the inner peripheral surface (inner wall) 10*a* of the treatment chamber 10 is illustrated. In the present embodiment, the treatment chamber 10 is a cylindrical container having an approximately flat bottom, having a drive axis 11 for installing the agitating blade 20 and the rotator 30 at the approximate center of the bottom.

Figure 4A:
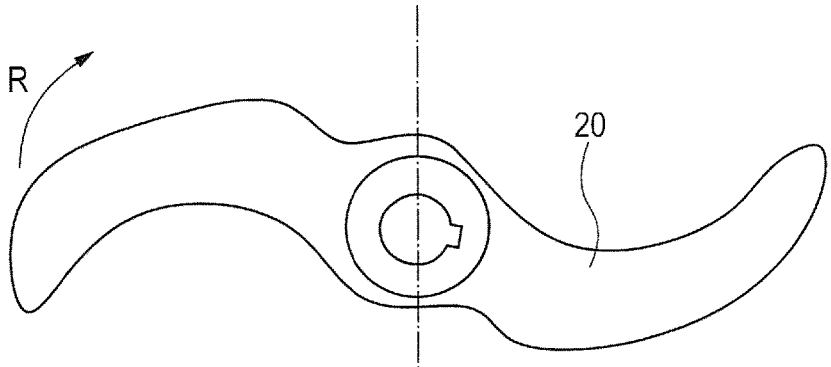
FIG. 4A is a schematic top view illustrating the structure of the agitation blade in an embodiment of a toner treating apparatus.
Figure 4B:
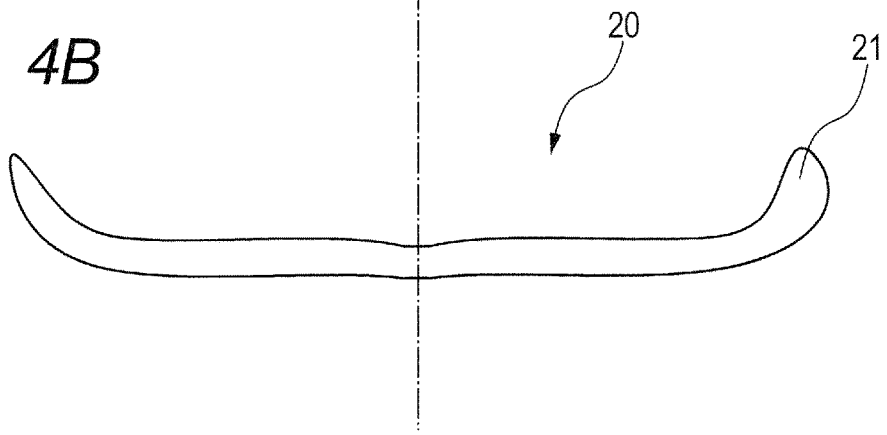
FIG. 4B is a schematic side view illustrating the structure of the agitation blade in an embodiment of a toner treating apparatus.

The schematic view of the agitating blade 20 as a blow-up unit is illustrated in FIGS. 4A and 4B. The top view is illustrated in FIG. 4A, and the side view is illustrated in FIG. 4B. In the present embodiment, the agitating blade 20 rotates so as to blow up the objects to be treated including the toner particle and the external additive in the treatment chamber 10. The agitating blade 20 has a blade part 21 extending from the rotation center to the outside (outward in the radial direction (toward outer diameter), outer diameter side). The leading edge of the blade part 21 has a flip-up shape for blowing up the objects to be treated. The agitating blade 20 is fixed to the drive axis 11 at the bottom of the treatment chamber 10. In the drawing, the rotation direction of the drive axis 11 is indicated by an arrow R. Due to the rotation of the agitating blade 20, the objects to be treated move upward in the treatment chamber 10 while rotating in the same direction as that of the rotating blade 20, and then move down by gravity. The objects to be treated are thus uniformly mixed.

Figure 1B:
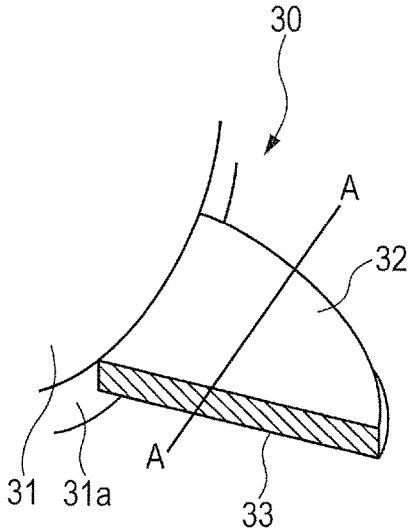
FIG. 1B is a schematic view (partial perspective view) illustrating the structure of the rotator in an embodiment of a toner treating apparatus.
Figure 1C:
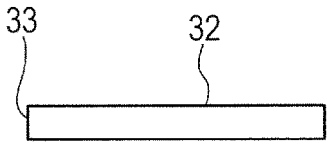
FIG. 1C is a schematic view (cross sectional view along A-A in FIG. 1B) illustrating the structure of a part of the rotator in an embodiment of a toner treating apparatus.
Figure 5A:
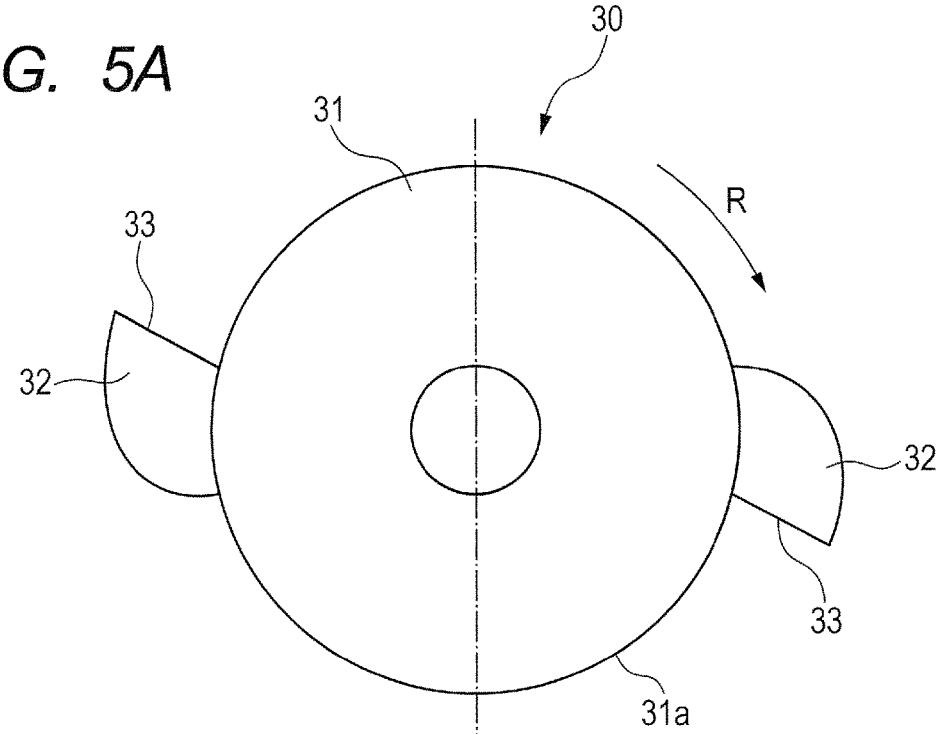
FIG. 5A is a schematic top view illustrating the structure of the rotator in an embodiment of a toner treating apparatus.
Figure 5B:
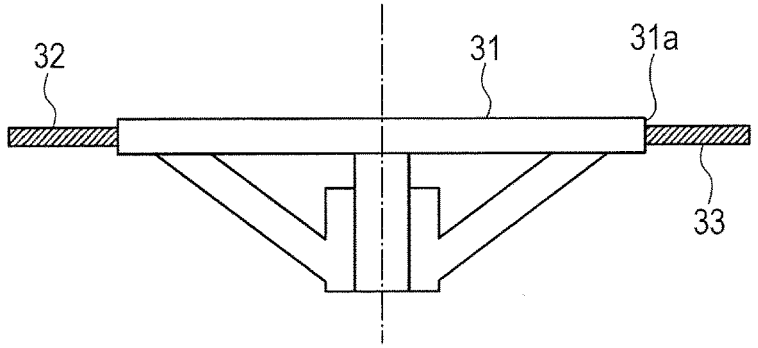
FIG. 5B is a schematic sectional side view illustrating the structure of the rotator in an embodiment of a toner treating apparatus.

The schematic views of the rotator 30 are illustrated in FIGS. 1A to 1C, and FIGS. 5A and 5B. FIG. 1A is a top view illustrating the rotator 30 installed in the treatment chamber 10, FIG. 1B is a perspective view illustrating the main part of the rotator 30, and FIG. 1C is a cross sectional view along A-A in FIG. 1B. FIG. 5A is a top view of the rotator 30, and FIG. 5B is a side view of the rotator 30.

In the present embodiment, the rotator 30 is disposed above the agitating blade 20 in the treatment chamber, being fixed to the same drive axis 11 as that of the agitating blade 20, rotatable in the same direction as that of the agitating blade 20 (arrow R direction).

The rotator 30 includes a rotator body 31, and a treating unit 32 having a treatment surface 33 which collides with the objects to be treated by the rotation of the rotator 30 for treatment of the objects to be treated. The treatment surface 33 extends from the outer peripheral surface 31*a* of the rotator body 31 toward the outer diameter, and includes a region remote from the rotator body 31 on the downstream side in the rotating direction of the rotator 30 in comparison with a region closer to the rotator body 31 than the former region.

The rotation of the rotator 30 causes collisions between the objects to be treated and the treatment surface 33, so that treatment of an external additive is performed.

In FIG. 1A, the radius L of the inner peripheral surface 10*a* of the treatment chamber 10 is illustrated. The center O of the rotator 31 and the inner peripheral surface 10*a* of the treatment chamber 10 is also illustrated. Further, the angle θ formed between the treatment surface and the tangent line of the circumference with the center O is illustrated in FIG. 1A.

In FIG. 1A, the angle θ formed between the treatment surface 33 and the tangent line b of the circle (indicated by a broken line) having a radius of 0.8 L, in particular, is illustrated. The outer end of the treatment surface 33 (a second region 33*b*) lies at a position away from the center O by a length of 0.95 L. The tangent line a of the circle with the center O, passing through the position of the second region 33*b* is indicated. Namely, the inner end of the treatment surface (a first region 33*a*) is present at the position of the treatment surface 33 on the outer peripheral surface 31*a* of the rotator 31.

Figure 6A:
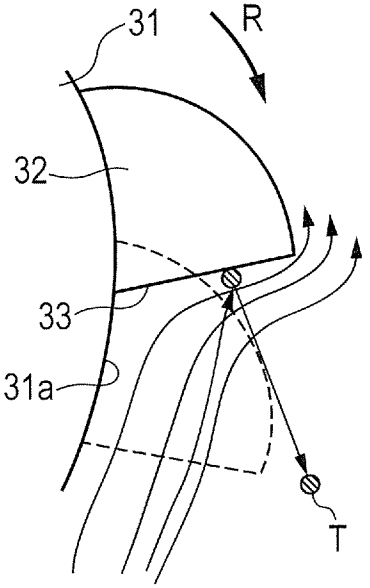
FIG. 6A is a view for illustrating the function of a treatment surface of a toner treating apparatus, in the case of $\theta<90°$.
Figure 6B:
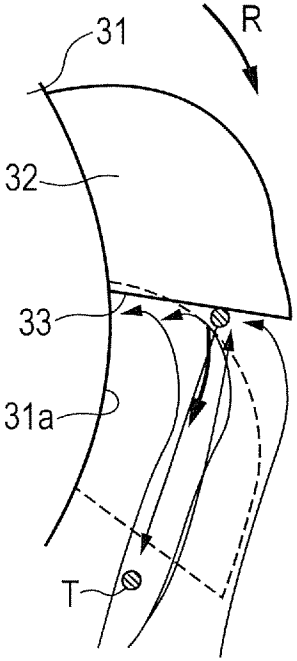
FIG. 6B is a view for illustrating the function of a treatment surface of a toner treating apparatus, in the case of $90°\leq\theta<130°$.
Figure 6C:
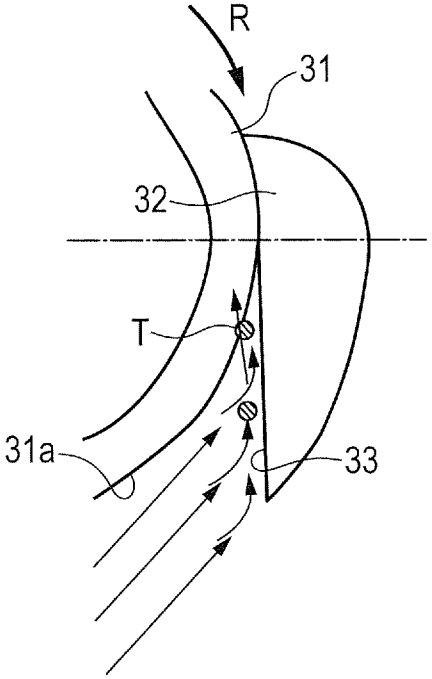
FIG. 6C is a view for illustrating the function of a treatment surface of a toner treating apparatus, in the case of $130°\theta$.

FIGS. 6A to 6C and FIGS. 7A and 7B are drawings for illustrating the function of the treatment surface 33. At the treatment surface 33, a conventional case with the below-described angle θ satisfying $\theta<90°$ is illustrated in FIG. 6A, a case with $130°\geq\theta>90°$ in the present embodiment is illustrated in FIG. 6B, and a case with $\theta>130°$ is illustrated in FIG. 6C. Also in FIGS. 6A to 6C and FIGS. 7A and 7B, the cross-sectional views of the treatment chamber 10 along the direction orthogonal to the rotation axis is illustrated at a position where the treatment surface 33 of the rotator 30 is present.

Figure 7A:
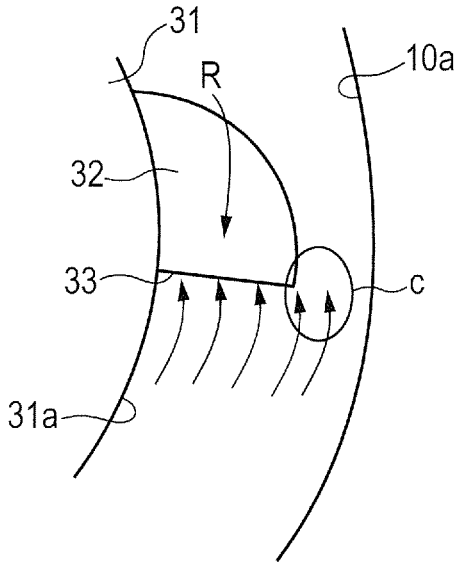
FIG. 7A is a view for illustrating the function of a treatment surface of a toner treating apparatus, in the case of $r<0.8$ L.
Figure 7B:
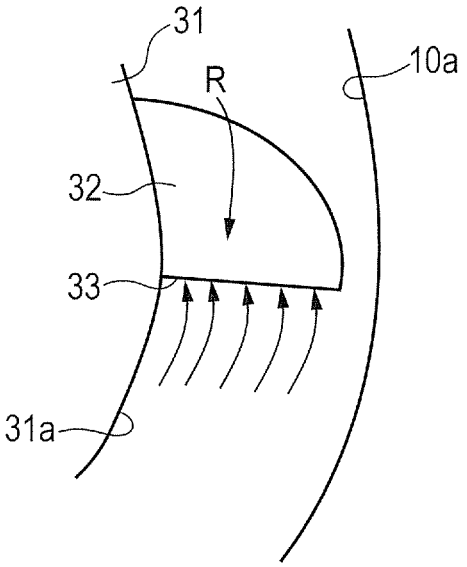
FIG. 7B is a view for illustrating the function of a treatment surface of a toner treating apparatus, in the case of $0.8$ L$\leq r$.

When the radius of a circle formed by the inner peripheral surface 10*a* of the treatment chamber 10 is represented by L, and the distance from the center of the circle formed by the inner peripheral surface 10*a* of the treatment chamber 10 to the end position of the treatment surface 33 farthest from the rotator body 31 is represented by r, a case with $r<0.80$ L is illustrated in FIG. 7A, and a case with r≥0.80 L is illustrated in FIG. 7B. For convenience of description, the component members in drawings illustrating conventional examples and Comparative Examples, which are similar to those in the present embodiment, are denoted by the same symbols as in the present embodiment.

The present inventors found that the treatment surface 33 of the toner treating apparatus 1 requires to have a region remote from the rotator body 31 on the downstream side in the rotating direction of the rotator 30 in comparison with a region closer to the rotator body 31.

It is presumed that the treatment surface in the embodiment allows the rotating objects to be treated with the treatment surface 33 once, and then to be hit back in the travel direction of the treatment surface 33 (treated and concurrently hit back with the treatment surface 33), as illustrated in FIG. 6B. The objects to be treated hit back in the travel direction of the treatment surface 33 can be located (retained) in the region through which the treatment surface 33 passing when the rotator 30 rotates, so that the rotationally moving treatment surface 33 can repeatedly treat the objects to be treated.

On this occasion, the treatment surface 33 extending from the outer peripheral surface 31*a* of the rotator body 31 toward the outer diameter can allow the objects to be treated to be rolled in (led in) between the treatment surface 33 and the outer peripheral surface 31*a*, as the locus of the objects T to be treated illustrated by arrows in FIG. 6B. The objects to be treated are thus hit back in the travel direction of the treatment surface 33, not escaping along the inner diameter side of the treatment surface 33. Consequently the object to be treated can be repeatedly treated with the treatment surface 33 in a more reliable manner.

The treatment surface in the embodiment enables the number of collisions to be increased, so that a short-term treatment can be achieved. AS a result, the external additive can be firmly fixed, with the diffusibility being retained, which is preferred.

More preferably, the end position of the treatment surface 33 farthest from the rotator body is more adjacent to the inner peripheral surface 10*a* (outer radial direction) than the position at 80% of the radius of the circle formed by the inner peripheral surface 10*a* of the treatment chamber 10, not contacting with the inner peripheral surface 10*a*. In other words, the following expression can be satisfied: 0.80 L≤r<L. In addition, the end position of the treatment surface 33 can be more adjacent to the rotator body 31 than the position at 99% of the radius of the circle formed by the inner peripheral surface 10*a* of the treatment chamber 10 (r≤0.99 L).

The end position of the treatment surface 33 in the range allows the treatment area to increase for the same height of the treatment surface 33 (length in the rotation axis direction of the drive axis 11), so that a large number of rotating objects to be treated can be treated, achieving a short-term treatment, which is preferred.

Due to rotary movement of the treatment surface 33, the closer the treatment surface 33 approaches the inner peripheral surface 10*a* of the treatment chamber 10, the higher the circumferential speed of the end part of the treatment surface 33 is. The treatment energy in collision with the objects to be treated increases with the increase of the circumferential speed of the treatment surface 33, so that firm fixing of the external additive can be achieved in a shorter time, which is preferred.

Further, when the line connecting a first region of the treatment surface 33 closest to the rotator body 31 with a second region on the treatment surface 33 located at a position 0.8 L away from the center of the circle formed by the inner peripheral surface of the treatment chamber is represented by a line a, and the tangent line of the circle passing through the second region at the second region is represented by a line b, an angle is formed between the line a and the line b. The angle downstream in the rotation direction (angle θ) can be larger than 90° and 130° or less.

With an angle θ in the range, the objects to be treated repeatedly collide with the treatment surface 33, without escape to the outside, as illustrated in FIG. 6B, so that a large number of collisions can be achieved in a short time. Consequently the external additive can be firmly fixed, with the diffusibility being retained, which is preferred.

The first region of the treatment surface 33 closest to the rotator body 31 can be located more adjacent to the inner peripheral surface (outer radial direction) than the position at 60% of the radius of the circle formed by the inner peripheral surface 10*a* of the treatment chamber 10. In other words, when the distance from the center of the circle formed by the inner peripheral surface 10*a* of the treatment chamber 10 to the first region of the treatment surface closest to the rotator body is represented by R, the following expression can be satisfied: R≥0.60 L.

With the length to the first region and the length to the end in the range, the whole treatment surface 33 has a sufficient circumferential speed, so that the treatment energy in collision with the objects to be treated increases. Consequently, firm fixing of the external additive can be achieved in a shorter time, which is preferred. In addition, the circumferential speeds of the first region and the end of the treatment surface 33 approximated to each other enable more uniform treatment of the objects to be treated, which is preferred.

In the present embodiment as illustrated in FIG. 7B, the treatment surface 33 extends longer toward the outer diameter (r≥0.80 L) in comparison with the treatment surface 33 with r<0.80 L (FIG. 7A). Consequently, in the case of having a same height (length of the drive axis 11 of the rotation direction) of the treatment surface 33 (toner treating apparatus having a same size), the treatment surface 33 in the present embodiment has a larger treatment area, capable of treating a large number of rotating objects to be treated. Due to the rotary movement of the treatment surface 33, the closer the treatment surface 33 approaches the inner peripheral surface 10*a* of the treatment chamber 10, the higher the circumferential speed of the tip part (outer diameter-side end, outer diameter end) of the treatment surface 33 is.

The treatment energy in collision with the objects to be treated increases with the increase of the circumferential speed of the treatment surface 33, so that it is presumed that the effect for crushing the object to be treated is enhanced.

In contrast, in the case of a structure illustrated in FIG. 7A, the treatment surface 33 extends shorter toward the outer diameter in comparison with the structure illustrated in FIG. 7B. Consequently, it is presumed that the probability of collisions with the objects to be treated is reduced. In addition, the treatment surface 33 is not present in the vicinity of the inner peripheral surface 10*a* of the treatment chamber 10 (region c in FIG. 7A), so that the circumferential speed of the tip part of the treatment surface 33 is slower than the circumferential speed in the case of the structure illustrated in FIG. 7B. Consequently, it is presumed that the effect for crushing the object to be treated is reduced.

The structure of the toner of the present invention is described as follows.

The toner of the present invention includes a toner particle which contains a binder resin, a colorant and a releasing agent, and an external additive which contains an organic-inorganic composite fine particle and an inorganic fine particle A. The toner may further include a charge control agent and a magnetic substance on an as needed basis.

The inorganic fine particle B of the organic-inorganic composite fine particle of the present invention can be silica or a metal oxide fine particle. The inorganic fine particle B of the organic-inorganic composite fine particle formed of silica or a metal oxide fine particle is excellent in chargeability and capable of imparting sufficient fluidity to the toner, well functioning as an external additive, which is preferred.

The organic-inorganic composite fine particle may be manufactured, for example, according to the description in the Examples in International Publication WO 2013/063291.

The number average particle diameter, the SF-1 and the SF-2 of the organic-inorganic composite fine particle may be appropriately controlled by changing the particle diameter of the inorganic fine particle B for use in the organic-inorganic composite fine particle, and the quantity ratio between the inorganic fine particle B and the resin particle.

The amount of an organic-inorganic composite fine particle added in the toner particle of the present invention can be 0.1 parts by mass or more and 4.0 parts by mass or less with respect to 100 parts by mass of toner particle.

The toner of the present invention includes an inorganic fine particle A for assisting the performance of chargeability and fluidity, in addition to the organic-inorganic composite fine particle.

Examples of the inorganic fine particle A include fluorine resin powder such as vinylidene fluoride fine powder and polytetrafluoroethylene fine powder; processed silica including fine powder silica such as wet-process silica and dry-process silica, fine powder titanium oxide and fine powder alumina, which are surface treated with a silane compound, a titanium coupling agent and silicone oil; an oxide such as zinc oxide and tin oxide; a complex oxide such as strontium titanate, barium titanate, calcium titanate, strontium zirconate and calcium zirconate; and a carbonate compound such as calcium carbonate and magnesium carbonate.

The inorganic fine particle A can be a fine particle formed by vapor phase oxidation of a silicon halide compound, which is referred to as so-called dry-process silica or fumed silica. For example, pyrolysis oxidation of silicon tetrachloride in oxyhydrogen flame is used based on the following reaction formula:

$$SiCl_4+2H_2+O_2 \rightarrow SiO_2+4HCl$$

In the manufacturing step, other metal halides such as aluminum chloride and titanium chloride may be used together with a silicon halide so as to produce a complex fine particle including silica and other metal oxides, which are included in silica.

Examples of the commercially available silica fine powder formed by vapor phase oxidation of silicon halide compound include AEROSIL 130, 200, 300, 380, TT600, MOX170, MOX80 and COK84 (manufactured by Nippon Aerosil Co., Ltd.), CAB-O-SIL M-5, MS-7, MS-75, HS-5, EH-5 (manufactured by Cabot Corporation), WACKER HDK N20 V15, N20E, T30, T40 (manufactured by Wacker-Chemie GmbH), D-C FINE SILICA (manufactured by Dow Corning Toray Co., Ltd.) and FRANSOL (manufactured by Fransil Company).

Further, more preferred examples of the inorganic fine particle A for use in the present invention include a hydrophobic processed silica fine particle formed by the vapor phase oxidation of a silicon halide compound.

The content of the inorganic fine particle A with respect to 100 parts by mass of a toner particle is preferably 0.01 parts by mass or more and 8 parts by mass or less, more preferably 0.1 parts by mass or more and 4 parts by mass or less. In the case of a plurality of particles corresponding to the inorganic fine particle A, the total content thereof is assumed to be the content.

The binder resin for use in the toner particle of the present invention is described as follows.

Examples of the binder resin include a polyester resin, a vinyl resin, an epoxy resin and a polyurethane resin.

The compositions of the polyester resin are, for example, as follows.

Examples of the alcohol component include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, bisphenol represented by the following formula [2] and a derivative thereof as hydrogenated bisphenol A, and diols represented by the following formula [3] as aromatic diol.

Formula [2]

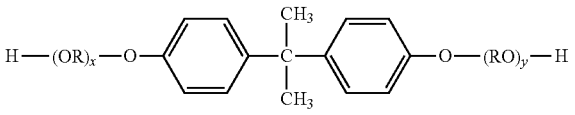

wherein R represents an ethylene or propylene group, x and y each represents integers of 1 or more, and the average of x+y is 2 to 10.

Formula [3]

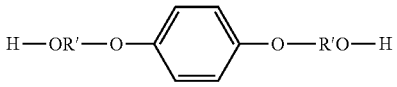

wherein R' represents —$CH_2CH_2$—, —$CH_2$—$CH(CH_3)$—, or —$CH_2$—$C(CH_3)(CH_3)$—.

Examples of the acid component include benzenedicarboxylic acids or anhydrides thereof such as phthalic acid, terephthalic acid, isophthalic acid, and phthalic anhydride; alkyldicarboxylic acids or anhydrides thereof such as succinic acid, adipic acid, sebacic acid, and azelaic acid, and succinic acid substituted with an alkyl group or alkenyl group having 6 or more and 18 or less carbon atoms or an anhydride thereof; an unsaturated dicarboxylic acid such as fumaric acid, maleic acid, citraconic acid, and itaconic acid or an anhydride thereof. Examples of the tri- or more valent polyalcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Examples of the tri- or more valent carboxylic acid component include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra(methylenecarboxyl)methane, 1,2,7,8-octanetetracarboxylic acid, Empol trimer acid, and an anhydride thereof.

The polyester resin is obtained by condensation polymerization which is commonly known.

Examples of the vinyl monomer for forming the vinyl resin component include: styrene; styrene and a derivative thereof such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, N-vinylpyrrolidone; and a derivative of acrylic acid or methacrylic acid such as acrylonitrile, methacrylonitrile, and acrylamide.

The examples further include an unsaturated dibasic acid such as maleic acid, citraconic acid, itaconic acid, alkenylsuccinic acid, fumaric acid, and mesaconic acid; an unsaturated dibasic acid anhydride such as maleic acid anhydrate, citraconic anhydride, itaconic acid anhydrate, and alkenylsuccinic acid anhydrate; a half ester of unsaturated dibasic acid such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenylsuccinic acid methyl half ester, fumaric acid methyl half ester, and mesaconic acid methyl half ester; an unsaturated dibasic acid ester such as dimethylmaleic acid and dimethylfumaric acid; an α,β-unsaturated acid such as acrylic acid, methacrylic acid, crotonic acid, and cinnamic acid; an α,β-unsaturated acid anhydride such as crotonic acid anhydride and cinnamic acid anhydride, and an anhydride of the α,β-unsaturated acid and a lower fatty acid; and a monomer having a carboxylic group such as alkenylmalonic acid, alkenylglutaric acid, alkenyl adipic acid, and an anhydride thereof and a monoester thereof.

The examples further include acrylic acid or methacrylic acid esters such as 2-hydroxyethyl acrylate, 2-hydroxyethyl methacrylate, and 2-hydroxypropyl methacrylate; and a monomer having a hydroxyl group such as 4-(1-hydroxy-1-methylbutyl)styrene, and 4-(1-hydroxy-1-methylhexyl) styrene.

The vinyl resin or the vinyl polymer unit of the toner of the present invention may include a cross-linking structure cross-linked with a cross-linking agent having 2 or more vinyl groups. Examples of the cross-linking agent which can be suitably used from the viewpoints of low-temperature fixability and offset resistance to resin components include: an aromatic divinyl compound (divinylbenzene and divinylnaphthalene); diacrylate compounds linked with an alkyl chain (ethylene glycol diacrylate, 1,3-butylene glycol diacrylate, 1,4-butanediol diacrylate, 1,5-pentanediol acrylate, 1,6-hexanediol diacrylate, neopentyl glycol diacrylate, and the above-mentioned compounds with the acrylate substituted with methacrylate); diacrylate compounds linked with an alkyl chain having an ether bond (e.g. diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above-mentioned compounds with the acrylate substituted with methacrylate); diacrylate compounds linked with a chain having an aromatic group and an ether bond [Polyoxyethylene(2)-2,2-bis(4-hydroxyphenyl)propane diacrylate, polyoxyethylene(4)-2,2-bis(4-hydroxyphenyl)propane diacrylate, and the above-mentioned compounds with the acrylate substituted with methacrylate]; and polyester type diacrylate compounds ("MANDA" manufactured by Nippon Kayaku Co., Ltd.).

Examples of the polyfunctional cross-linking agent include pentaerythritol triacrylate, trimethylolethane triacrylate, trimethylolpropane triacrylate, tetramethylolmethane tetraacrylate, oligoester acrylate, and the above-described compounds with the acrylate substituted with methacrylate; and triallyl cyanurate and triallyl trimellitate.

The cross-linking agent is used in an amount of, preferably 0.01 parts by mass or more and 10.00 parts by mass or less, more preferably 0.03 parts by mass and 5.00 parts by mass or less, with respect to 100 parts by mass of other monomer components.

Examples of the cross-linking agent which can be suitably used from the viewpoints of low-temperature fixability to resin components and offset resistance include an aromatic divinyl compound (divinylbenzene, in particular) and diacrylate compounds linked with a chain having an aromatic group and an ether bond.

Examples of the polymerization initiator for use in the polymerization of the vinyl resin or the vinyl polymer unit include: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2-azobis(2-methylpropane), ketone peroxides such as methyl ethyl ketone peroxide, acetyl acetone peroxide, and cyclohexanon peroxide, 2,2-bis(tert-butylperoxy) butane, tert-butyl hydroperoxide, cumene hydroperoxide, 1,1,3,3-tetramethylbutyl hydroperoxide, di-tert-butylperoxide, tert-butyl cumyl peroxide, dicumyl peroxide, α-α'-bis (tert-butyl peroxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, di-isopropyl peroxydicarbonate, di-2-ethylhexyl peroxydicarbonate, di-n-propyl peroxydicarbonate, di-2-ethoxyethyl peroxycarbonate, dimethoxy isopropyl peroxydicarbonate, di(3-methyl-3-methoxybutyl)peroxycarbonate, acetylcyclohexyl sulfonyl peroxide, tert-butyl peroxyacetate, tert-butyl peroxyisobutyrate, tert-butyl peroxyneodecanoate, tert-butyl peroxy-2-ethylhexanoate, tert-butyl peroxylaurate, tert-butyl peroxybenzoate, tert-butyl peroxyisopropylcarbonate, di-tert-butyl peroxyisophthalate, tert-butyl peroxyallylcarbonate, tert-amyl peroxy-2-ethylhexanoate, di-tert-butyl peroxyhexahydroterephthalate, and di-tert-butyl peroxyazelate.

Examples of the releasing agent for use in the present invention include an aliphatic hydrocarbon wax such as a polyolefin copolymer, a polyolefin wax, a microcrystalline wax, paraffin wax, and a Fisher Tropsch wax. The molecular weight distribution of the releasing agent may be sharpened by a press-sweating method, a solvent method, a recrystallization method, a vacuum distillation method, a supercritical gas extraction method, or a melt crystallization method. Specific examples of the releasing agent include SASOL H1, H2, C80, C105, C77 (manufactured by Sasol Wax GmbH), HNP-1, HNP-3, HNP-9, HNP-10, HNP-11, HNP-12 (manufactured by Nippon Seiro Co., Ltd.), UNILIN (registered trade mark) 350, 425, 550 and 700, and UNICID (registered trade mark) 350, 425, 550 and 700 (manufactured by Toyo ADL Corporation (formerly Toyo Petrolite Co., Ltd.).

A charge control agent can be used in the toner of the present invention, in order to stabilize the chargeability. An organometallic complex or a chelate compound is effective as the charge control agent, easily causing an interaction between the metal in the center and the acid group or the hydroxyl group present at the terminal of the binder resin for use in the present invention. Examples thereof include a monoazo metal complex; an acetylacetone metal complex; and a metal complex or a metal salt of aromatic hydroxycarboxylic acid or aromatic dicarboxylic acid.

Specific examples for use include SPILON BLACK TRH, T-77 and T-95 (manufactured by Hodogaya Chemical Co., Ltd.), and BONTRON (registered trade mark) S-34, S-44, S-54, E-84, E-88 and E-89 (manufactured by Orient Chemical Industries Co., Ltd.). In addition, a charge control resin may be used in combination with the charge control agent.

The toner of the present invention may include a magnet substance. In general, the magnetic substance also serves as a colorant.

Examples of the magnetic substance contained in the toner include an iron oxide such as magnetite, hematite and ferrite, a metal such as iron, cobalt and nickel, or an alloy and a mixture of the metal and a metal such as aluminum, cobalt, copper, lead, magnesium, tin, zinc, antimony, bismuth, calcium, manganese, titanium, tungsten and vanadium.

The magnetic substance has an number average particle diameter of 0.05 μm or more and 2.0 μm or less, preferably 0.10 μm or more and 0.50 μm or less. The amount contained in the toner is 30 parts by mass or more and 120 parts by mass or less with respect to 100 parts by mass of the binder resin, particularly preferably 40 parts by mass or more and 110 parts by mass or less with respect to 100 parts by mass of the binder resin.

Conventional colorants may be used, including, for example, a black colorant, a yellow colorant, a magenta colorant, and a cyan colorant.

A carbon black, a grafted carbon, and a black-toned mixture of the following yellow/magenta/cyan colorants can be used as the black colorant.

Typical examples of the yellow colorant include a condensed azo compound, an isoindolinone compound, an anthraquinone compound, an azo metal complex, a methine compound, and an allylamide compound.

Examples of the magenta colorant include condensed azo compound, a diketopyrrolopyrrole compound, an anthraquinone compound, a quinacridone compound, a basic dye lake compound, a naphthol compound, a benzimidazolone compound, a thioindigo compound, and a perylene compound.

Examples of the cyan colorant include a copper phthalocyanine compound and a derivative thereof, an anthraquinone compound, and a basic dye lake compound.

The colorants may be used alone, or mixed for use, or may be used in a solid solution state.

The colorant is selected from the viewpoints of the hue angle, the chroma, the brightness, the weatherability, the OHP transparency, and the dispersibility into toner. The amount of the colorant added can be 1 part by mass or more and 20 parts by mass or less with respect to 100 parts by mass of the binder resin.

The toner of the present invention can be manufactured by a crushing method. The toner manufactured by a crushing method has a shape which allows the energy in the collision with a treatment surface to be directed to the treatment of an external additive without loss.

The crushing method includes:

(1) sufficiently mixing a binder resin, a colorant, and a releasing agent, and, on an as needed basis, a particle of magnetic substance and other additives with a mixer such as a Henschel mixer and a ball mill;

(2) melting and kneading the produced mixture with a heat kneader such as a biaxial kneading extruder, a heating roll, a kneader and an extruder;

(3) crushing the mixture after solidification by cooling; and (4) classifying the crushed product, so as to obtain the toner particle.

In order to control the shape and the surface properties of the toner particle, the surface can be treated after crushing or classification.

Examples of the mixer include: a Henschel mixer (manufactured by Nippon Coke & Engineering Co., Ltd.); a super mixer (manufactured by Kawata Mfg. Co., Ltd.); a conical ribbon mixer (manufactured by Okawara Mfg. Co., Ltd.); a Nauta mixer, a turbulizer, Cyclomix (manufactured by Hosokawa Micron Corporation); a spiral pin mixer (manufactured by Pacific Machinery & Engineering Co., Ltd.); and a Loedige mixer (manufactured by Matsubo Corporation).

Examples of the kneader include: a KRC kneader (manufactured by Kurimoto, Ltd.); a Buss co-kneader (manufactured by Buss Compounding Systems AG); a TEM type extruder (manufactured by Toshiba Machine Co., Ltd.); a TEX biaxial kneader (manufactured by Japan Steel Works, Ltd.); a PCM kneader (manufactured by Ikegai Corp. (formerly Ikegai Ironworks)); a three roll mill, a mixing roll mill, a kneader (manufactured by Inoue Mfg., Inc.); KNEADEX (manufactured by Nippon Coke & Machine Co., Ltd.); an MS pressure kneader, a KNEADERUDER (manufactured by Nihon Spindle Manufacturing Co., Ltd. (formerly Moriyama Seisakusho)); and a Banbury mixer (manufactured by Kobe Steel Ltd.).

Examples of the crusher include: a counter jet mill, a micron jet, INOMIZER (manufactured by Hosokawa Micron Corporation); an IDS mill, a PJM jet crusher (manufactured by Nippon Pneumatic Mfg. Co., Ltd.); a cross jet mill (manufactured by Kurimoto, Ltd.); ULMAX (manufactured by Nisso Engineering Co., Ltd.); SK JET-O-MILL (manufactured by Seishin Enterprise Co., Ltd.); CRIPTRON (manufactured by Earthtechnica Co., Ltd. (formerly Kawasaki Heavy Industries, Ltd.); a turbo mill (manufactured by Freund-Turbo Corporation (formerly Turbo Kogyo)); and SUPER ROTOR (manufactured by Nisshin Engineering Co., Ltd.).

Examples of the classifier include: CLASSIEL, MICRON CLASSIFIER, SPEDIC CLASSIFIER (manufactured by Seishin Enterprise Co., Ltd.); a turbo classifier (manufactured by Nisshin Engineering Inc.); MICRON SEPARATOR, TURBOPREX (ATP), TSP SEPARATOR (manufactured by Hosokawa Micron Corporation); ELBOWJET (manufactured by Nittetsu Mining Co., Ltd.), a dispersion separator (manufactured by Nippon Pneumatic Mfg. Co., Ltd.); and YM MICROCUT (manufactured by Uras Techno Co., Ltd. (formerly Yasukawa Shouji)).

Examples of the surface modification apparatus include: FACULTY (manufactured by Hosokawa Micron Corporation), MECHANOFUSION (manufactured by Hosokawa Micron Corporation), NOBIRUTA (manufactured by Hosokawa Micron Corporation), HYBRIDIZER (manufactured by Nara Machinery Co., Ltd.), INOMIZER (manufactured by Hosokawa Micron Corporation), THETA COMPOSER (manufactured by Tokuju Co., Ltd.), and MECHANO MILL (manufactured by Okada Seiko Co., Ltd.).

Examples of the sieve apparatus for sieving coarse particles include: ULTRASONIC (manufactured by Shoei Sangyo Co., Ltd.); RESONASIEVE, GYROSHIFTER (manufactured by Tokuju Co., Ltd.); VIBRASONIC SYSTEM (manufactured by Dalton Co., Ltd.); SONICLEAN (manufactured by Sintokogyo, Ltd.); TURBOSCREENER (manufactured by Freund-Turbo Corporation (formerly Turbo Kogyo)); MICROSHIFTER (manufactured by Makino Mfg. Co., Ltd.); and a circular vibrating sieve.

The toner treating apparatus for use in the present invention is described in detail as follows.

It is more preferred that the treatment surface 33 linearly extends from the outer peripheral surface of the rotator body 31 toward the outer diameter. As illustrated in FIG. 1B and FIG. 1C, the treatment surface 33 in the present embodiment is plane having an approximately rectangular shape in approximately parallel with the drive axis 11 illustrated in FIG. 3.

The treatment surface 33 linearly extends from the outer peripheral surface 31*a* of the rotator body 31 toward the outer diameter, so that it is presumed that the collisions with the objects to be treated are effective to proceed the treatment.

Examples of the suitable embodiment of the treating unit 32 other than the ones illustrated in FIG. 1A and FIG. 1B include the ones illustrated in the following.

Figure 8A:
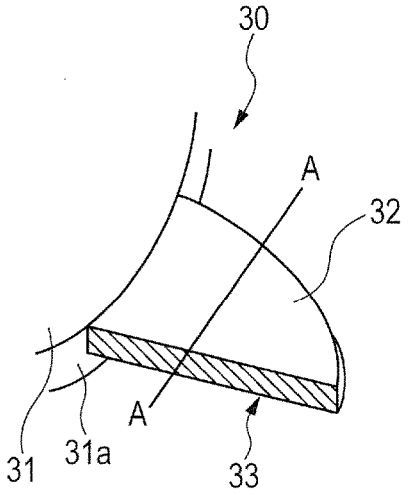
FIG. 8A is a schematic view (partial perspective view) illustrating a part of the structure of the rotator in another embodiment of a toner treating apparatus.

FIGS. 8A to 8F are schematic views illustrating the treating unit 32 in other embodiments. Although the same drawing is illustrated in FIG. 8A as in FIG. 1B, the shape in the cross section along A-A may include any one illustrated in FIGS. 8A to 8F. Further, the shape of the treating unit 32 may include any one illustrated in FIGS. 9A to 9D and FIGS. 10A and 10B.

Each of the embodiments illustrated in FIGS. 8A to 10B is described as follows.

Figure 8B:
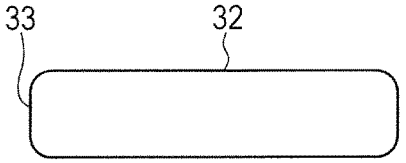
FIG. 8B is a cross sectional view along A-A in FIG. 8A, as a schematic side view illustrating the treatment surface in another embodiment.

In FIG. 8B, a structure of the treatment surface 33 having chamfers (round chamfers) at both ends in the direction of drive axis 11 is illustrated in the cross sectional view along A-A.

Figure 8C:
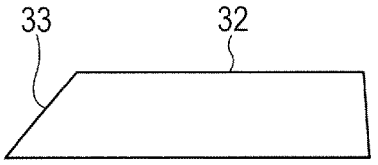
FIG. 8C is a cross sectional view along A-A in FIG. 8A, as a schematic side view illustrating the treatment surface in another embodiment.
Figure 8D:
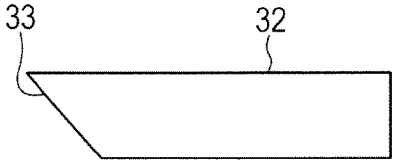
FIG. 8D is a cross sectional view along A-A in FIG. 8A, as a schematic side view illustrating the treatment surface in another embodiment.

In FIG. 8C and FIG. 8D, a structure of the treatment surface 33 tilted from the drive axis 11 at an angle is illustrated.

Figure 8E:
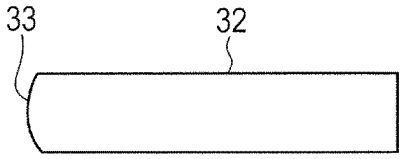
FIG. 8E is a cross sectional view along A-A in FIG. 8A, as a schematic side view illustrating the treatment surface in another embodiment.

In FIG. 8E, a structure of the treatment surface 33 having a central part in the axis direction of drive axis 11 with a convex curvature toward the downstream side in the rotation direction R of the rotator 30 is illustrated.

Figure 8F:
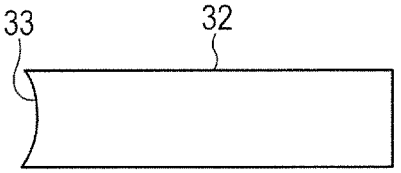
FIG. 8F is a cross sectional view along A-A in FIG. 8A, as a schematic side view illustrating the treatment surface in another embodiment.

In FIG. 8F, a structure of the treatment surface 33 having a central part in the axis direction of the drive axis 11 with a concave curvature toward the upstream side in the rotation direction R of the rotator 30 is illustrated.

Figure 9A:
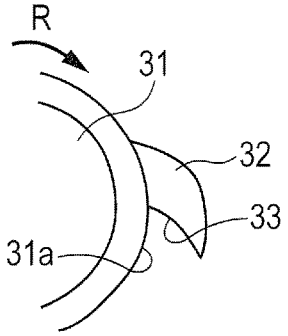
FIG. 9A is a schematic top view illustrating a part of the structure of the rotator in another embodiment of a toner treating apparatus.
Figure 9B:
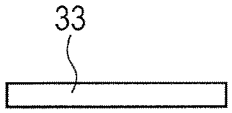
FIG. 9B is an enlarged side view illustrating the treating unit in FIG. 9A.

In FIG. 9A, a structure of the treatment surface 33 having a concave curvature toward the upstream side in the rotation direction R of the rotator 30, when viewed from the axis direction of the drive axis 11, is illustrated. In FIG. 9B, the treatment surface 33 illustrated in FIG. 9A viewed from the downstream side in the rotation direction R of the rotator 30 is illustrated.

Figure 9C:
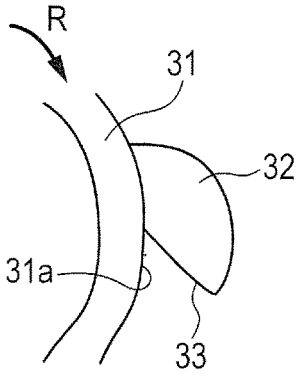
FIG. 9C is a schematic top view illustrating a part of the structure of the rotator in another embodiment of a toner treating apparatus.
Figure 9D:
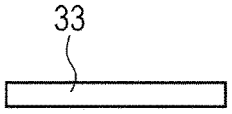
FIG. 9D is an enlarged side view illustrating the treating unit in FIG. 9C.

In FIG. 9C, a structure of the treatment surface 33 having a convex curvature toward the downstream side in the rotation direction R of the rotator 30, when viewed from the axis direction of the drive axis 11, is illustrated. In FIG. 9D, the treatment surface 33 illustrated in FIG. 9C viewed from the downstream side in the rotation direction R of the rotator 30 is illustrated.

Figure 10A:
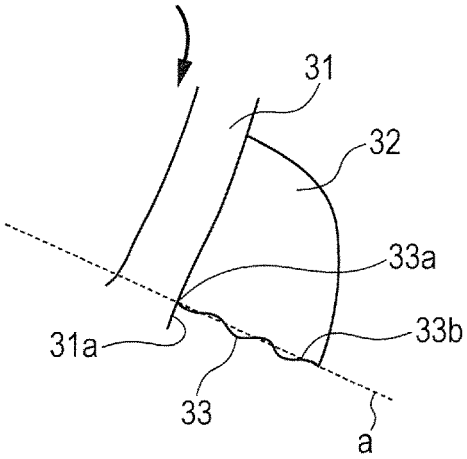
FIG. 10A is a schematic top view illustrating a part of the structure of the rotator in another embodiment of a toner treating apparatus.
Figure 10B:
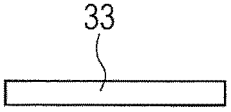
FIG. 10B is an enlarged side view illustrating the treating unit in FIG. 10A.

In FIGS. 10A and 10B, a structure of the treatment surface 33 having a concave-convex shape along the line a connecting a first region 33*a* to a second region 33*b* of the treatment surface 33, when viewed from the axis direction of the drive axis 11, is illustrated.

Subsequently, methods for measuring each of the physical properties of the present invention are described as follows.

<Method for Measuring the Number Average Particle Diameter of Organic-Inorganic Composite Fine Particle>

The number average particle diameter (D1) of the primary organic-inorganic composite fine particle is measured with a scanning electron microscope "S-4800" (trade name, manufactured by Hitachi High-Technologies Corporation (formerly Hitachi, Ltd.)). In observation of the organic-inorganic composite fine particle and the toner after external addition of the organic-inorganic composite fine particle, the major axis of randomly selected 100 pieces of primary organic-inorganic composite fine particles in a field of view at a maximum magnification of 200000 is measured to obtain the number average particle diameter (D1). The magnification for observation is appropriately adjusted depending on the size of the organic-inorganic composite fine particle.

<Method for Measuring the Shape Factor SF-2 of Organic-Inorganic Composite Fine Particle>

The shape factor SF-2 of the organic-inorganic composite fine particle is measured with a scanning electron microscope "S-4800" (trade name, manufactured by Hitachi High-Technologies Corporation). After external addition of the organic-inorganic composite fine particle, the toner is observed to make the following calculation.

The magnification for observation is appropriately adjusted depending on the size of the organic-inorganic composite fine particle. The circumference length and the area of randomly selected 100 pieces of primary organic-inorganic composite fine particles in a field of view at a maximum magnification of 200000 is calculated with image analysis software "Image-Pro Plus 5.1J" (manufactured by Roper Technologies, Inc.).

The SF-2 is obtained from the average of the calculation based on the following formula.

$$SF\text{-}2=(\text{circumference length of particle})^2/(\text{particle area})\times 100/4\pi$$

<Method for Measuring the Proportion of the Firmly Fixed Organic-Inorganic Composite Fine Particle and the Proportion of the Loosely Adhered Organic-Inorganic Composite Fine Particle>

In the first place, the toner is ultrasonically dispersed in an ion exchange water including several drops of "CONTAMINON N" (10 mass % aqueous solution of a neutral detergent for washing a precision measuring instrument, with a pH of 7, including a non-ionic surfactant, an anionic surfactant, and an organic builder; manufactured by Wako Pure Chemical Industries, Ltd.) with Ultra Sonic Cleaner VS-150 (manufactured by AS ONE Corporation), and the dispersion is left standing for 24 hours. The supernatant solution is sampled and dried to isolate the external additive. In the case of a toner including a plurality of external additives, the supernatant solution is centrifuged to achieve the isolation of the organic-inorganic composite fine particle with a high-speed centrifuge H-9R (manufactured by KOKUSAN Co. Ltd) at 5,000 rpm for 1 minute in an environment at 25° C.

A standard amount of the isolated organic-inorganic composite fine particle is again dispersed in an ion exchange water including several drops of CONTAMINON N, so as to prepare a standard solution.

Subsequently, the toner is dispersed in an ion exchange water including several drops CONTAMINON N, and the dispersion is dispersed by ultrasonic for 10 seconds. The toner particle is then precipitated by centrifugation. The precipitated toner particle is again dispersed by ultrasonic for 20 seconds, and the toner particle is precipitated by centrifugation. The precipitated toner particle is again dispersed by ultrasonic for 60 seconds, and the toner particle is precipitated by centrifugation. Each of the supernatant solution in this stage and the standard solution are measured with a disc centrifuge particle size analyzer DC24000UHR (available from Nihon Rufuto Co., Ltd.). Based on the comparison of the peak area emerging at the position for the particle diameter of the organic-inorganic composite fine particle, the proportion of the loosely adhered organic-inorganic composite fine particle is determined.

The whole number of parts of the organic-inorganic composite fine particle added is obtained as follows. After the 1.0 g of toner is dispersed in 10 g of an ion exchange water including several drops CONTAMINON N, the dispersion is subject to ultrasonication for 3 hours. The toner particle is then precipitated by centrifugation. The amount of the organic-inorganic composite fine particle present in the supernatant in this stage is determined with the disc centrifuge particle size analyzer as the whole number of parts of the organic-inorganic composite fine particle added. The proportion (parts by mass) of the firmly fixed organic-inorganic composite fine particle is obtained by subtracting the proportion (parts by mass) of loosely adhered particle from the whole number of parts.

The ultrasonication is subjected under the following device and conditions.

Ultrasonic homogenizer VP-050 (manufactured by TAITEC Corporation)

Microchip: step type microchip, tip diameter 2 mm

Tip position of microchip: the center of a glass vial, and 5 mm height from the bottom of the glass vial Ultrasonic conditions:

Strength 30%

Ultrasonic is applied while cooling the glass vial through the use of ice water to prevent raising a temperature of the dispersion.

<Method for Measuring Unit Diffusion Index>

The unit diffusion index in the present invention is obtained from the following formula.

$$\text{Unit diffusion index} = Sr/Si$$

Sr: the measured organic-inorganic composite fine particle coverage ratio on the toner particle surface.

Si: the organic-inorganic composite fine particle coverage ratio on the toner particle surface, when the organic-inorganic composite fine particle is dispersed in an ideal manner.

The Sr is calculated from the analysis of the toner surface image taken by Hitachi ultra-high resolution field emission-type scanning electron microscope S-4800 (manufactured by Hitachi High-Technologies Corporation) with image analysis software Image-Pro Plus 5.0 (manufactured by Roper Technologies, Inc.). The imaging conditions for the S-4800 are as follows.

(1) Sample Preparation

A conductive paste is thinly applied to a sampling stage (aluminum sampling stage: 15 mm by 6 mm), on which the toner is sprayed. An excess amount of the toner is removed from the sampling stage by air blow, and the sampling stage is sufficiently dried. The sampling stage is set in a sample holder, and the height of the sampling stage is adjusted to 36 mm using a sample height gauge.

(2) Observation Condition Setting for S-4800

The organic-inorganic composite fine particle coverage ratio is calculated using an image obtained by the reflected electron image observation of S-4800. The reflected electron image has less charge ups in comparison with a secondary electron image, so that the organic-inorganic composite fine particle coverage rate can be accurately measured.

An anti-contamination trap installed to the mirror body of S-4800 is filled with liquid nitrogen to overflowing, which is then left standing for 30 minutes. The "PC-SEM" of S-4800 is started up for flushing (cleaning of an FE tip as an electron source). The accelerating voltage display portion in the control panel in the screen is clicked. The [Flushing] button is pressed to open the Flushing execution dialog. The flushing intensity is confirmed to be at 2 before execution of the flushing. The emission current due to flushing is confirmed to be 20 to 40 μA. The sample holder is put in a sample chamber of the mirror body of S-4800. [HOME] on the control panel is pressed to transfer the sample holder to the observation position.

The accelerating voltage display portion is clicked to open the HV setting dialog, and the accelerating voltage is set to [0.8 kV] and the emission current is set to [20 μA]. In the [SEM] tab of the operation panel, the SIGNAL SELECT is set to [SE], [Upper (U)] and [+BSE] are selected for the SE Detector, and [L.A.100] is selected in the selection box on the right of [+BSE] so as to enter a mode for reflection electron image observation.

Similarly, in the [SEM] tab of the operation panel, the probe current, the focus mode, and WD of an electron optical system condition block are set to [Normal], [UHR], and [3.0 mm], respectively. The [ON] button in the accelerating voltage display portion of the control panel is pressed for accelerating voltage application.

(3) Focus Adjustment

The magnification is set to 5000 (5 k) by dragging in the magnification display portion in the control panel. The focus knob [COARSE] of the operation panel is rotated, and the aperture alignment is adjusted at a position where the whole field of vision is in focus to some extent. The [Align] in the control panel is clicked to display the Alignment dialog, and [Beam] is selected. A STIGMA/ALIGNMENT knob (X, Y) on the operation panel is rotated to move the displayed beam to the center of concentric circles. Subsequently, [Aperture] is selected, and the STIGMA/ALIGNMENT knob (X, Y) is rotated one at a time, such that the movement of an image is stopped or minimized. The Aperture dialog is closed, and focusing is achieved using autofocus. The procedures are repeated two more times to achieve focusing.

Subsequently, the magnification for the objective toner is set to 10000 (10 k) by dragging in the magnification display portion in the control panel, in a state with the center of maximum diameter being aligned with the center of the measurement screen. The focus knob [COARSE] of the operation panel is rotated, and the aperture alignment is adjusted at a position where the whole field of vision is in focus to some extent. The [Align] in the control panel is clicked to display the Alignment dialog, and [Beam] is selected. A STIGMA/ALIGNMENT knob (X, Y) on the operation panel is rotated to move the displayed beam to the center of concentric circles. Subsequently, [Aperture] is selected, and the STIGMA/ALIGNMENT knob (X, Y) is rotated one at a time, such that the movement of an image is stopped or minimized. The Aperture dialog is closed, and focusing is achieved using autofocus. Subsequently, the magnification is set to 50000 (50 k), and focus adjustment is performed in the same way as described above, using the focus knob and the STIGMA/ALIGNMENT knob. Focusing is again achieved using autofocus. The procedures are again repeated to achieve focusing. The measurement accuracy of the coverage ratio tends to be lowered, when the observation surface has a large tilt angle. Accordingly, selection of samples having the whole observation surface in focus at the same time during focus adjustment allows the samples having no surface tilt to be selected as feasible as possible for the analysis.

(4) Image Storage

Brightness adjustment is performed in an ABC mode, and a photograph is taken with a size of 640×480 pixels, and stored. Using the image file, the following analysis is performed. One photograph is taken for each toner particle, and images are obtained for at least 30 toner particles.

(5) Image Analysis

In the present invention, the organic-inorganic composite fine particle coverage ratio is calculated by binarizing the image obtained by the procedure, using the image analysis software. On this occasion, the one image is divided into 12 squares, each of which is analyzed.

The coverage ratio is calculated by analysis of a surrounded square region. On this occasion, the area (C) of the region is adjusted to 24000 to 26000 pixels.

The region of contour of the organic-inorganic composite fine particle is defined to calculate the organic-inorganic composite fine particle coverage area (D).

From the square region area C and the organic-inorganic composite fine particle coverage area D, the coverage ratio Sr is obtained by the following formula:

$$Sr(\%)=D/C\times 100$$

The organic-inorganic composite fine particle coverage ratio is calculated for at least 30 toner particles. The average of the whole data obtained is defined as Sr of the present invention.

The Si is obtained as follows.

In the first place, the number (N) of the organic-inorganic composite fine particle contained in 1 g of toner is calculated from the mass (Ay) [g] contained in 1 g of toner, the density (Gy) [g/m$^3$], and the particle diameter (Dy) [m] of the organic-inorganic composite fine particle. Ay is measured with the disc centrifuge particle size analyzer as described above. Gy is measured with a dry-type automatic densimeter ACCUPICK 1330 manufactured by Shimadzu Corporation. Dy is measured with a scanning electron microscope S-4800 as described above. The calculation formula for N is as follows:

$$N=Ay/(4/3\cdot\pi\cdot(Dy/2)^3\cdot Gy)$$

Subsequently, among the electron microscopic images taken in parallel with the measurement of Sr, at least 30 organic-inorganic composite fine particles mono-dispersed without cohesion are selected, and 10 of which are selected in an ascending order from the smallest area so as to calculate the average. The average is defined as the coverage area (S1) [m$^2$] per one piece of the organic-inorganic composite fine particle.

Further, the surface area (Sm) [m$^2$] per 1 g of toner particle with all the external additives being liberated is measured with an "automatic specific surface area/pore size distribution measuring apparatus TRISTAR 3000 (manufactured by Shimadzu Corporation)". The TRISTAR3000 adopts a constant volume gas adsorption method for the measurement.

These values are substituted in the following formula.

$$Si(\%)=N\times S1/Sm\times 100$$

<Method for Measuring BET Specific Area of Inorganic Fine Particle A>

The method for measuring BET specific area of inorganic fine particle A is according to JIS 28830 (2001).

As the measurement apparatus, "automatic specific surface area/pore size distribution measuring apparatus TriStar 3000 (manufactured by Shimadzu Corporation)" is employed, using a constant volume gas adsorption method for the measurement. Setting of the measurement conditions and analysis of the measurement data are performed using special software "TriStar 3000 Version 4.00" belonging to the apparatus. A vacuum pump, a nitrogen gas piping, and a helium gas piping are connected to the apparatus. Nitrogen gas is used as adsorbing gas. The value calculated from the BET multi point method is defined as the BET specific area of the present invention.

EXAMPLES

With reference to Examples and Comparative Examples, the present invention is described in more detail as follows, though the present invention is not limited thereto. The number of parts in Examples and Comparative Examples are all based on mass, unless otherwise specified.

<Manufacturing Example of Polyester Resin 1>

Bisphenol-A ethylene oxide adduct (addition: 2.2 mol): 100 parts

Terephthalic acid: 60.0 parts

Trimellitic anhydride: 20.0 parts

Acrylic acid: 10.0 parts

A four-neck flask was charged with the polyester monomer, to which a pressure reducing apparatus, a water separation apparatus, a nitrogen gas introduction apparatus, a thermometer, and an agitation apparatus were mounted. The polyester monomer was agitated at 160° C. under nitrogen atmosphere. After completion of the reaction, the product was taken out from the container, cooled and pulverized, so as to obtain a polyester resin 1. The polyester resin 1 had a Tg of 90.3° C., and a softening point of 135.5° C.

<Manufacturing Example of Polyester Resin 2>

Bisphenol-A propylene oxide adduct (addition: 2.2 mol): 60.0 parts

Bisphenol-A ethylene oxide adduct (addition: 2.2 mol): 40.0 parts

Terephthalic acid: 77.0 parts

A 5-liter autoclave was charged with the polyester monomer mixture and dibutyltin oxide in an amount of 0.2 mass % with respect to the total amount of monomer, to which a reflux condenser, a moisture separator, a nitrogen gas introduction apparatus, a thermometer, and an agitation apparatus were mounted. A polycondensation reaction was performed at 230° C., with introduction of $N_2$ gas into the autoclave. The reaction time was adjusted to obtain a desired softening point. After completion of the reaction, the product was taken out from the container, cooled and pulverized, so as to obtain a polyester resin 2. The polyester resin 2 had a Tg of 58.5° C., and a softening point of 90° C.

<Manufacturing Example of Toner Particle 1>

Polyester resin 1: 60.0 parts

Polyester resin 2: 40.0 parts

Spherical magnetic iron oxide: 60.0 parts (Number average particle diameter=0.20 μm, Hc=11.5 kA/m, σs=88 $Am^2/kg$, σr=14 $Am^2/kg$)

Releasing agent: 2.0 parts (Fisher Tropsch wax (manufactured by Sasol Wax GmbH; C105; melting point 105° C.)

Charge control agent (T-77: manufactured by Hodogaya Chemical Co., Ltd.): 2.0 parts The materials were pre-mixed with a Henschel mixer, and then melt-kneaded with a biaxial kneading extruder.

The produced kneaded product was cooled, coarsely pulverized with a hammer mill, and pulverized with a mechanical pulverizer (T-250, manufactured by Freund-Turbo Corporation). The produced finely pulverized powder was classified with a multi-fraction classifier using the Coanda effect, so as to obtain a raw material toner particle with a negative chargeability, having a weight average particle diameter (D4) of 7.0 μm.

The raw material toner particle was subjected to surface modification with a surface modification apparatus FACULTY (manufactured by Hosokawa Micron Corporation). On this occasion, the circumferential speed of a dispersion rotor was set to 150 m/sec, the input of the finely pulverized product was set to 7.6 kg per one cycle, and the surface modification time (=cycle time, time from completion of raw material supply to opening of a discharge valve) was set to 82 seconds. The discharge temperature of toner particle was 44° C. Through the steps described above, the toner particle 1 was obtained.

<Manufacturing Example of Organic-Inorganic Composite Fine Particles 1 to 5>

The organic-inorganic composite fine particle can be manufactured according to the description in Examples of International Publication No. WO 2013/063291.

The organic-inorganic composite fine particle for use in the below-described Examples was prepared according to Example 1 of International Publication No. WO 2013/063291, using silica described in Table 1. The physical properties of organic-inorganic composite fine particles 1 to 5 are described in Table 1.

In the measurement by differential scanning calorimetry (DSC), the organic-inorganic composite fine particles 1 to 5 had no exothermic peak, no endothermic peak, and no glass transition point (Tg) in the range from 20° C. to 220° C.

<Manufacturing Example of Organic-Inorganic Composite Fine Particle 6>

A resin particle having a number average particle diameter of 100 nm in an amount of 100 parts and a colloidal silica having a number average particle diameter of 25 nm in an amount of 4 parts are mixed with a Henschel mixer, so that an organic-inorganic composite fine particle 6 was obtained. The physical properties of the organic-inorganic composite fine particle 6 are described in Table 1.

<Manufacturing Example of Organic-Inorganic Composite Fine Particle 7>

An organic-inorganic composite fine particle 7 can be manufactured according to the Examples of Japanese Patent No. 4321272. The organic-inorganic composite fine particle for use in the below-described Examples was prepared according to the manufacturing example of a complex resin particle in Japanese Patent No. 4321272, using silica described in Table 1. The physical properties of the organic-inorganic composite fine particle 7 are described in Table 1.

The prepared organic-inorganic composite fine particle had a structure with a convex portion derived from an inorganic fine particle B on the surface of the resin particle.

TABLE 1

| | Inorganic fine particle | | Organic-inorganic composite fine particle | | |
|---|---|---|---|---|---|
| | B in organic-inorganic composite fine particle | | Inorganic fine | Number average | |
| | Type | Particle diameter [nm] | particle content [mass %] | particle diameter [nm] | SF-2 |
| Organic-inorganic composite fine particle 1 | Colloidal silica | 25 | 55.0 | 113 | 112 |
| Organic-inorganic composite fine particle 2 | Colloidal silica | 25 | 66.5 | 106 | 116 |
| Organic-inorganic composite fine particle 3 | Colloidal silica | 15 | 46.2 | 99 | 104 |
| Organic-inorganic composite fine particle 4 | Colloidal silica | 25 | 27.6 | 335 | 106 |
| Organic-inorganic composite fine particle 5 | Colloidal silica | 15 | 64.1 | 62 | 104 |
| Organic-inorganic composite fine particle 6 | Colloidal silica | 15 | 40.0 | 100 | 130 |
| Organic-inorganic composite fine particle 7 | Colloidal silica | 15 | 28.6 | 270 | 110 |

<Other Additives>

In the below-described manufacturing example of toner, an inorganic fine particle 1 of colloidal silica was used as an additive other than the organic-inorganic composite fine particle. The inorganic fine particle 1 had a number average particle diameter of 100 nm, and an SF-2 of 100.

<Inorganic Fine Particles A1 to A5>

A hydrophobic silica fine particle having a surface treated with hexamethyldisilazane was used as an inorganic fine particle A. The BET specific surface area thereof is described in Table 2.

TABLE 2

| | BET specific area [$m^2/g$] |
|---|---|
| Inorganic fine particle A1 | 200 |
| Inorganic fine particle A2 | 400 |
| Inorganic fine particle A3 | 100 |
| Inorganic fine particle A4 | 300 |
| Inorganic fine particle A5 | 380 |

<Manufacturing Example of Toner Treating Apparatus 1>

The specific structure of a toner treating apparatus is described in detail with reference to FIG. 2.

A treatment chamber 10 is a cylindrical container having an effective volume of 10 L with an inner height of 250 mm and an inner diameter ϕ of 230 mm as illustrated in FIG. 2, including a drive axis 11 at the center of the flat bottom. The drive of the drive motor 50 is transmitted to a drive axis 11 through a drive belt. The control part 60 including a power switch, a drive start switch, a drive stop switch, a rotation speed control volume, a rotation speed display part, a product temperature display part, and the like controls the motion of the toner treating apparatus.

As described above, an agitating blade 20 illustrated in FIG. 4A and FIG. 4B to blow up the objects to be treated from the bottom of the treatment chamber 10 in an upward direction is fixed to the drive axis 11 inside the treatment chamber 10. The s-shaped agitating blade 20 for use has a flip-up shaped leading edge. Further, a rotator 30 illustrated in FIG. 5A and FIG. 5B is fixed to the same drive axis 11 above the agitating blade 20.

The rotator 30 includes treating units 32 projecting from the outer peripheral surface 31*a* of the rotator body 31 in an annular shape toward the outer diameter at two places.

The treatment surface 33 has an angle θ of 100 degrees as illustrated in FIG. 6B. The treatment surface 33 includes a first region closest to the rotator body 31 at 65% of the radius of the inner peripheral surface 10*a*, and an end position farthest from the rotator body 31 at 95% of the radius of the inner peripheral surface 10*a*.

A toner treating apparatus 1 includes the structure described above.

<Toner Treating Apparatuses 2 to 8>

Treating apparatuses 2 to 8 including the same structure as in the toner treating apparatus 1 were prepared, except that the angle θ of the treatment surface 33, the ratio of the length from the drive axis to the first region of the treatment surface 33 closest to the rotator body 31 to the radius of the inner peripheral surface 10*a*, and the ratio of the length from the drive axis to the second region of the treatment surface 33 farthest from the rotator body 31 to the radius of the inner peripheral surface 10*a* were changed as described in Table 3.

<Toner Treating Apparatus 9>

A treating apparatus 9 having the same treatment surface 33 as in the toner treating apparatus 1 includes 4 treating units in total. In other words, in addition to the two treating units 32 opposed to each other around the drive axis 11, two more treating units were added at the intermediate points between the existing two treatment points.

TABLE 3

| | Angle θ | Position of treatment surface closest to rotator body | Position of treatment surface farthest from rotator body |
|---|---|---|---|
| Toner treating apparatus 1 | 100 degree | 0.65L | 0.94L |
| Toner treating apparatus 2 | 100 degree | 0.60L | 0.99L |
| Toner treating apparatus 3 | 100 degree | 0.55L | 0.80L |
| Toner treating apparatus 4 | 130 degree | 0.65L | 0.94L |
| Toner treating apparatus 5 | 91 degree | 0.65L | 0.94L |
| Toner treating apparatus 6 | 136 degree | 0.65L | 0.94L |
| Toner treating apparatus 7 | 100 degree | 0.65L | 0.75L |
| Toner treating apparatus 8 | 85 degree | 0.65L | 0.94L |
| Toner treating apparatus 9 | 100 degree | 0.65L | 0.94L |

L represents the radius of a circle formed by the inner peripheral surface of a treatment chamber at the cross section of the treatment chamber in the direction orthogonal to the rotation axis, at the position where the treatment surface of the rotator is present.

<Manufacturing Example of Toner 1>

[First Mixing Step]

To 100.0 parts of the toner particle 1, 1.0 part of the organic-inorganic composite fine particle 1 was added, and the mixture was mixed with the toner treating apparatus 1 at 3200 rpm for 8 minutes.

[Second Mixing Step]

To the mixture obtained in the first mixing step, 0.8 parts of the inorganic fine particle A1 was added, and the mixture was mixed with the toner treating apparatus 1 at 3200 rpm for 1 minute, so that a toner 1 was obtained. The physical properties of the toner 1 are described in Table 4.

In addition, the number average particle diameter (D1) and the shape factor SF-2 of the organic-inorganic composite fine particle 1 analyzed from the toner 1 were the same as the values described in Table 1.

<Manufacturing Examples 2 to 20>

Toners 2 to 20 were obtained by the same way as in the case of toner 1, except that the organic-inorganic composite fine particle, the inorganic fine particle A, and the type of toner treating apparatus were changed as described in Table 5. The physical properties of the obtained toners 2 to 20 are described in Table 4.

In manufacturing the toner 2, however, 0.3 parts by mass of the inorganic fine particle A was added in parallel with the addition of the organic-inorganic composite fine particle in the first mixing step, and the remaining 0.7 parts by mass of the inorganic fine particle A was added in the second mixing step.

Further, in manufacturing the toner 14, 15 and 20, the whole amount of the inorganic fine particle A was inputted in parallel with the addition of the organic-inorganic composite fine particle, without performing the second mixing step. The number average particle diameter (D1) and the shape factor SF-2 of the organic-inorganic composite fine particles 1 to 7 analyzed from the toners 2 to 20 were the same as the values described in Table 1.

TABLE 4

| | Organic-inorganic composite fine particle | | |
|---|---|---|---|
| | Proportion Y of firmly fixed particle [part by mass] | Proportion X-Proportion Y [part by mass] | Unit diffusion index |
| Toner 1 | 0.79 | 0.21 | 0.77 |
| Toner 2 | 0.45 | 0.20 | 0.77 |
| Toner 3 | 2.95 | 0.20 | 0.77 |
| Toner 4 | 0.73 | 0.27 | 0.75 |
| Toner 5 | 0.79 | 0.21 | 0.76 |
| Toner 6 | 3.00 | 0.30 | 0.75 |
| Toner 7 | 0.58 | 0.17 | 0.77 |
| Toner 8 | 0.84 | 0.16 | 0.80 |
| Toner 9 | 0.74 | 0.26 | 0.76 |
| Toner 10 | 0.85 | 0.15 | 0.76 |
| Toner 11 | 0.75 | 0.25 | 0.75 |
| Toner 12 | 0.75 | 0.25 | 0.75 |
| Toner 13 | 0.70 | 0.30 | 0.75 |
| Toner 14 | 0.37 | 0.63 | 0.96 |
| Toner 15 | 0.80 | 0.20 | 0.41 |
| Toner 16 | 3.20 | 0.80 | 0.82 |
| Toner 17 | 0.80 | 0.20 | 0.53 |
| Toner 18 | 0.80 | 0.20 | 0.49 |
| Toner 19 | 0.65 | 0.35 | 0.20 |
| Toner 20 | 0.50 | 0.50 | 0.94 |

TABLE 5

| | Organic-inorganic composite fine particle | | Inorganic fine particle A | | | First stage operating condition | | Second stage operating condition | |
|---|---|---|---|---|---|---|---|---|---|
| | Type | Number of part added (proportion X) [part by mass] | Type | Number of part added [part by mass] | Toner treating apparatus | Rotation speed [rpm] | Treating time [min] | Rotation speed [rpm] | Treating time [min] |
| Toner 1 | 1 | 1.00 | A1 | 1.00 | Toner treating apparatus 1 | 3200 | 8.0 | 3200 | 1.0 |
| Toner 2 | 1 | 0.65 | A1 | 1.00 | Toner treating apparatus 1 | 3200 | 8.0 | 3200 | 1.0 |
| Toner 3 | 1 | 3.15 | A1 | 1.00 | Toner treating apparatus 9 | 3200 | 4.0 | 3200 | 0.5 |
| Toner 4 | 2 | 1.00 | A1 | 1.00 | Toner treating apparatus 1 | 3705 | 8.0 | 3200 | 1.0 |
| Toner 5 | 3 | 1.00 | A1 | 1.00 | Toner treating apparatus 1 | 3200 | 8.0 | 3200 | 1.0 |
| Toner 6 | 4 | 3.30 | A1 | 1.00 | Toner treating apparatus 1 | 3874 | 8.0 | 3200 | 1.0 |
| Toner 7 | 5 | 0.75 | A1 | 1.00 | Toner treating apparatus 1 | 3032 | 8.0 | 3200 | 1.0 |
| Toner 8 | 1 | 1.00 | A2 | 1.00 | Toner treating apparatus 2 | 3200 | 8.7 | 3200 | 1.0 |
| Toner 9 | 1 | 1.00 | A3 | 1.00 | Toner treating apparatus 3 | 3368 | 8.0 | 3200 | 1.0 |
| Toner 10 | 1 | 1.00 | A4 | 1.00 | Toner treating apparatus 4 | 3200 | 8.0 | 3200 | 1.0 |
| Toner 11 | 1 | 1.00 | A5 | 1.00 | Toner treating apparatus 5 | 3537 | 8.0 | 3200 | 1.0 |
| Toner 12 | 1 | 1.00 | A1 | 1.00 | Toner treating apparatus 6 | 3200 | 8.0 | 3200 | 1.0 |
| Toner 13 | 1 | 1.00 | A1 | 1.00 | Toner treating apparatus 7 | 3368 | 8.0 | 3200 | 1.0 |
| Toner 14 | 1 | 1.00 | A1 | 1.00 | Toner treating apparatus 8 | 3200 | 2.0 | All inputted in first stage | |
| Toner 15 | 1 | 1.00 | A1 | 1.00 | Toner treating apparatus 8 | 3200 | 12.0 | All inputted in first stage | |
| Toner 16 | 1 | 4.00 | A1 | 1.00 | Toner treating apparatus 1 | 3200 | 8.0 | 3200 | 1.0 |
| Toner 17 | Inorganic particle 1 | 1.00 | A1 | 1.00 | Toner treating apparatus 1 | 3200 | 8.0 | 3200 | 1.0 |
| Toner 18 | 6 | 1.00 | A1 | 1.00 | Toner treating apparatus 1 | 3200 | 8.0 | 3200 | 1.0 |
| Toner 19 | Inorganic particle 1 | 1.00 | A1 | 1.00 | Toner treating apparatus 8 | 3200 | 10.0 | 3200 | 5.0 |
| Toner 20 | 7 | 1.00 | A4 | 1.00 | Toner treating apparatus 8 | 3200 | 2.0 | All inputted in first stage | |

Examples 1 to 13, and Comparative Examples 1 to 7

Evaluation on Durability Performance of Toner

A laser beam printer HP LaserJet Enterprise M806dn and a predetermined cartridge (manufactured by Hewlett-Packard) were modified for use as an evaluation machine.

The HP LaserJet Enterprise M806dn machine was modified to have a process speed of 400 mm/s, which is higher than the original process speed. The cartridge was filled with toner in amount of 1800 g, which is more than the normal charge for the product. With this change, the size of the agitating blade was increased to improve the circulation of the toner.

With a mode including printing 2 sheets of horizontal line pattern having a coverage rate of 5% per job and stopping the machine between the jobs before starting the subsequent job, a testing was performed for outputting a total of 600000 sheets. The image densities of the 100-th and 600000-th sheet were measured and occurrence of melt adhesion on a developing sleeve caused by liberated external additives was checked at the same time. The evaluation was performed under high temperature and high humidity environment (32.5° C., 85% RH), i.e. more severe conditions for outputting images, lowering the charging properties of toner.

The image density was measured with a Macbeth density meter (manufactured by X-rite, Inc. (formerly Macbeth Gretag Co.), through the measurement of reflection density of a solid black image of 5 mm-circle using a SPI filter. The developability increases with the numerical value. The specific evaluation criteria were as follows.

A: 1.45 or more

B: 1.40 or more and less than 1.45

C: 1.35 or more and less than 1.40

D: less than 1.35

<Evaluation on Contamination of Developing Sleeve>

In evaluation on the durability performance, the occurrence of melt adhesion on a developing sleeve caused by liberated external additives was evaluated by visual inspection, in parallel with testing for image evaluation. The evaluation criteria were as follows.

A: No contamination.

B: Occurrence of 1 or more and 4 or less vertical streaks.

C: Occurrence of 5 or more vertical streaks, without image impairment.

D: Occurrence of 5 or more vertical streaks, with image impairment caused by non-uniform toner coverage on a developing sleeve.

The evaluation results are described in Table 6.

TABLE 6

| | | Image density | | Melt adhesion on developing sleeve | |
|---|---|---|---|---|---|
| | Toner No. | 100-th sheet | 600000-th sheet | When checking 100-th sheet | When checking 600000-th sheet |
| Example 1 | 1 | A (1.52) | A (1.50) | A | A |
| Example 2 | 2 | B (1.44) | C (1.37) | A | A |
| Example 3 | 3 | A (1.46) | A (1.51) | A | B |
| Example 4 | 4 | B (1.44) | B (1.42) | A | A |
| Example 5 | 5 | B (1.42) | C (1.36) | A | A |
| Example 6 | 6 | B (1.44) | C (1.37) | B | B |
| Example 7 | 7 | A (1.50) | C (1.36) | A | A |
| Example 8 | 8 | A (1.52) | B (1.43) | B | B |
| Example 9 | 9 | B (1.42) | B (1.40) | C | C |
| Example 10 | 10 | B (1.41) | B (1.40) | A | A |
| Example 11 | 11 | B (1.44) | B (1.41) | B | B |
| Example 12 | 12 | C (1.36) | B (1.40) | B | B |
| Example 13 | 13 | B (1.43) | C (1.35) | C | C |
| Comparative Example 1 | 14 | B (1.42) | — | D | — |
| Comparative Example 2 | 15 | C (1.36) | D (1.20) | B | B |

TABLE 6-continued

| | | Image density | | Melt adhesion on developing sleeve | |
|---|---|---|---|---|---|
| | Toner No. | 100-th sheet | 600000-th sheet | When checking 100-th sheet | When checking 600000-th sheet |
| Comparative Example 3 | 16 | B (1.43) | C (1.35) | B | D |
| Comparative Example 4 | 17 | C (1.36) | D (1.20) | C | D |
| Comparative Example 5 | 18 | D (1.30) | — | D | — |
| Comparative Example 6 | 19 | C (1.37) | — | D | — |
| Comparative Example 7 | 20 | B (1.42) | — | D | — |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-161479, filed Aug. 7, 2014, which is hereby incorporated by reference herein in its entirety.

What is claimed is:

1. A toner comprising a toner particle containing a binder resin, a colorant and a releasing agent, and an external additive containing (i) an organic-inorganic composite fine particle having a number average particle diameter (D1) of 50-500 nm and a shape factor SF-2 of 103-120 as measured at a magnification of 200,000, and (ii) an inorganic fine particle A having a BET specific surface area of 50-400 $m^2/g$, wherein the organic-inorganic composite fine particle:

(1) comprises a resin particle and an inorganic fine particle B which is embedded in the resin particle, and has a surface with a convex portion derived from the inorganic fine particle B;

(2) has a proportion Y (parts by mass) of a particle firmly fixed to the toner particle of 0.45 to 3.00 parts by mass with respect to 100 parts by mass of the toner particle; and (3) $X-Y \leq 0.30$ when a content proportion of the organic-inorganic composite fine particle is X parts by mass with respect to 100 parts by mass of the toner particle;

the organic-inorganic composite fine particle has a unit diffusion index of 0.75 or more on the toner particle surface when unit diffusion index=(organic-inorganic composite fine particle coverage ratio on toner particle surface obtained from measurement)/(organic-inorganic composite fine particle coverage ratio on toner particle surface for ideal diffusion of organic-inorganic composite fine particle).

2. A method for manufacturing a toner including a toner particle containing a binder resin, a colorant and a releasing agent, and an external additive containing (i) an organic-inorganic composite fine particle having a number average particle diameter (D1) of 50-500 nm and a shape factor SF-2 of 103-120 as measured at a magnification of 200,000, and (ii) an inorganic fine particle A having a BET specific surface area of 50-400 $m^2/g$, comprising:

(A) a first mixing step of mixing the toner particle and the organic-inorganic composite fine particle using a treating apparatus having a rotator in a treatment chamber so as to produce a mixture; and (B) a second mixing step of mixing the mixture and the inorganic fine particle A using a treating apparatus having a rotator in a treatment chamber so as to produce a toner, wherein the organic-inorganic composite fine particle:

(1) comprises a resin particle and an inorganic fine particle B which is embedded in the resin particle, and has a surface with a convex portion derived from the inorganic fine particle B;

(2) has a proportion Y (parts by mass) of a particle firmly fixed to the toner particle of 0.45 to 3.00 parts by mass with respect to 100 parts by mass of the toner particle; and (3) $X-Y \leq 0.30$ when a content proportion of the organic-inorganic composite fine particle is X parts by mass with respect to 100 parts by mass of the toner particle;

the organic-inorganic composite fine particle has a unit diffusion index of 0.75 or more on the toner particle surface when unit diffusion index=(organic-inorganic composite fine particle coverage ratio on toner particle surface obtained from measurement)/(organic-inorganic composite fine particle coverage ratio on toner particle surface for ideal diffusion of organic-inorganic composite fine particle).

3. The method for manufacturing a toner according to claim 2, wherein the rotator of the treating apparatus for use in the first mixing step comprises a rotator body and a treatment surface for treating objects to be treated by collision with the objects to be treated caused by the rotation of the rotator;

the treatment surface extends outward from the outer peripheral surface of the rotator body in the radial direction, and has a region remote from the rotator body on the downstream side in the rotating direction of the rotator, in comparison with a region closer to the rotator body than the former region.

4. The method for manufacturing a toner according to claim 3, in the cross section of the treatment chamber in the direction orthogonal to the rotation axis of the rotator, at a position where the treatment surface of the rotator is present, $0.80\ L \leq r \leq L$ when L represents the radius of a circle formed by the inner peripheral surface of the treatment chamber, and r represents the distance from the center of the circle formed by the inner peripheral surface of the treatment chamber to the end position of the treatment surface farthest from the rotator body.

5. The method for manufacturing a toner according to claim 4, in the cross section of the treatment chamber in the direction orthogonal to the rotation axis of the rotator, at a position where the treatment surface of the rotator is present, $R \geq 0.60\ L$ and $r \leq 0.99\ L$ when L represents the radius of a circle formed by the inner peripheral surface of the treatment chamber, R represents the distance from the center of a circle formed by the inner peripheral surface of the treatment chamber to a first region of the treatment surface closest to the rotator body, and r represents the distance from the center of the circle formed by the inner peripheral surface of the treatment chamber to the end position of the treatment surface farthest from the rotator body.

6. The method for manufacturing a toner according to claim 3, in the cross section of the treatment chamber in the direction orthogonal to the rotation axis of the rotator, at a position where the treatment surface of the rotator is present, an angle formed between a line a and a line b is larger than 90° and 130° or less on the downstream side in the rotation direction, wherein L represents the radius of a circle formed by the inner peripheral surface of the treatment chamber, the line a connects a first region on the treatment surface closest to the rotator body with a second region on the treatment surface located at a position 0.80 L away from the center of the circle on the treatment surface, the line b is the tangent line of a concentric circle passing through the second region at the second region, the concentric circle is concentric with the circle.

* * * * *